US005655180A

United States Patent [19]

Yasuda et al.

[11] Patent Number: 5,655,180

[45] Date of Patent: Aug. 5, 1997

[54] TONER CARTRIDGE WITH A ROTARY ELEMENT WHICH IS ATTACHABLE TO AND DETACHABLE FROM A DEVELOPING APPARATUS

[75] Inventors: Shinichiro Yasuda, Sennan-gun; Masayuki Maruta, Hannan, both of Japan

[73] Assignee: Kao Corporation, Tokyo, Japan

[21] Appl. No.: 405,351

[22] Filed: Mar. 16, 1995

[30] Foreign Application Priority Data

Mar. 19, 1994 [JP] Japan ..... 6-074378
Mar. 19, 1994 [JP] Japan ..... 6-074395

[51] Int. Cl.[6] ..... G03G 21/00

[52] U.S. Cl. ..... 399/106; 399/258; 399/263

[58] Field of Search ..... 355/200, 260

[56] References Cited

U.S. PATENT DOCUMENTS 5,150,162 9/1992 Saito ..... 355/260
5,248,847 9/1993 Aoyama ..... 355/260 X
5,345,297 9/1994 Katakabe et al. ..... 355/260
5,481,344 1/1996 Yasuda et al. ..... 355/260

FOREIGN PATENT DOCUMENTS 59-93471 5/1984 Japan .
60-80878 5/1985 Japan .
3-47569 5/1991 Japan .

*Primary Examiner*—Fred L. Braun
*Attorney, Agent, or Firm*—Oblon, Spivak, McClelland, Maier & Neustadt, P.C.

[57] ABSTRACT

A rotary element is rotatably attached to a cartridge main body, which is attachable to and detachable from a developing apparatus. The rotary element has an opening/closing portion for a toner outlet formed in the main body, a toner-collecting portion for collecting the toner housed in the main body, and a joint connectable to a rotation driving element provided on the developing apparatus. When the main body is detached from the developing apparatus, the outlet opening/closing portion is pressed against the periphery of the outlet. By rotation of the rotary element, the toner-collecting portion collects the toner in the main body. The toner collected is supplied to the developing apparatus via the outlet.

7 Claims, 24 Drawing Sheets

TONER CARTRIDGE WITH A ROTARY ELEMENT WHICH IS ATTACHABLE TO AND DETACHABLE FROM A DEVELOPING APPARATUS

FIELD OF THE INVENTION

The present invention relates to a toner cartridge for toner supply to a developing apparatus for a copying machine etc.

DESCRIPTION OF THE PRIOR ART

There has been proposed a toner cartridge for supplying a toner to a developing apparatus for a copying machine etc., wherein the toner is supplied by removing a sealing element, which seals the toner outlet of the cartridge main body, after the main body is attached to the developing apparatus (see Unexamined Japanese Patent Publication SHO No. 59 - 93471 and Unexamined Japanese Utility Model Publication HEI No. 3 - 47569). However, it is troublesome to remove the sealing element. In addition, because the outlet of the toner cartridge detached from the developing apparatus after toner supply remains open, the toner adhering to the inner face of the main body scatters, contaminating the inside and outside of the copying machine, the worker's skin, wears, etc.

There has also been proposed a toner cartridge having a valve element for closing the toner outlet of the cartridge main body, wherein the toner is supplied by pressing up the valve element by a pressing-up element provided on the developing apparatus (see Unexamined Japanese Patent Publication SHO No. 60 - 80878). However, the valve element restricts the opening area of the toner outlet, so that smooth discharge of the toner is hampered.

The present invention was developed to solve the above problems. Accordingly, the object of the present invention is to provide a toner cartridge capable of smoothly supplying a toner by simple operation without toner scattering.

SUMMARY OF THE INVENTION

The present invention is applied to a toner cartridge comprising a main body attachable to and detachable from a developing apparatus, the main body having an outlet which is faced downwardly to discharge the toner when the main body is attached to the developing apparatus, and a rotary element rotatably attached to the main body, the rotary element having a toner-collecting portion housed in the main body and a joint connectable to a rotation driving element provided on the developing apparatus.

According to the first aspect of the present invention, the rotary element has an opening/closing portion for the outlet, and a means for pressing the opening/closing portion against the periphery of the outlet when the main body is detached from the developing apparatus is provided, wherein rotation of the rotary element causes the opening/closing portion to move between a position above the outlet and a position laterally distanced from the outlet, and causes the toner-collecting portion to collect the toner. According to this configuration, it is possible to rotate the rotary element by the rotation driving element via the joint when the main body is attached to the developing apparatus, to move the opening/closing portion between a position above the outlet and a position laterally distanced from the outlet. When the opening/closing portion is moved to the position laterally distanced from the outlet, the toner is dropped from the outlet and is supplied to the developing apparatus. By collecting the toner with the toner-collecting portion by the rotation of the rotary element, the toner is stirred and is introduced to the outlet of the main body to allow smooth toner discharge from the outlet. When the main body is detached from the developing apparatus, the opening/closing portion is pressed against the periphery of the outlet, therefore, toner fall from the outlet is prevented. By providing the rotary element with both the opening/closing portion and the toner-collecting portion to open/close the outlet and collect the toner by the rotation of the rotary element, the outlet opening/closing mechanism and the toner-collecting mechanism share parts, resulting in a decreased number of parts and simplified assembly. It is preferable that the toner cartridge of the present invention comprises a stopper movable between a position for preventing the rotation of the rotary element relative to the main body and a position for allowing the rotation, and a means for forcing the stopper to go to the rotation-preventing position, wherein the stopper is movable to the rotation-allowing position when the main body is attached to the developing apparatus. By this configuration, the stopper prevents the accidental rotation of the rotary element relative to the main body when the main body is detached from the developing apparatus, to prevent the accidental fall of the toner from the outlet. It is preferable that the rotary element is vertically movably attached to the main body, and the stopper is unified to the rotary element and is movable to the rotation-allowing position by pressing up the rotary element by the rotation driving element. By unifying the stopper to the rotary element, the stopper can be shifted to the rotation-allowing position solely by pressing up the rotary element by the driving element, resulting in a decreased number of parts and simplified assembly. Alternatively, it is preferable that the stopper is vertically movably attached to both the main body and the rotary element, and is movable to the rotation-allowing position by being pressed up by the rotation driving element, and the opening/closing portion also serves as the toner-collecting portion. By this configuration, the outlet can be opened and closed solely by rotating the rotary element without vertical motion of the rotary element, and the structure can be simplified by allowing the opening/closing portion to serve as a toner-collecting portion.

According to the second aspect of the present invention, the toner-collecting face of the toner-collecting portion is inclined against the radial direction of the rotary element, so as to radially move the toner and introduce the toner to the above-described outlet by the rotation of the rotary element. According to this configuration, when the main body is attached to the developing apparatus and the rotary element is rotated by the rotation driving element via the joint, the toner-collecting portion radially moves the toner housed in the main body and introduces the toner to the outlet. Therefore, the toner is certainly dropped from the outlet and is supplied to the developing apparatus. It is preferable that the rotary element has an opening/closing portion for the outlet, and a means for pressing the opening/closing portion against the periphery of the outlet when the main body is detached from the developing apparatus, wherein the opening/closing portion can be raised from the periphery of the outlet by pressing up the rotary element by the rotation driving element when the main body is attached to the developing apparatus. By this configuration, it is possible to prevent toner leakage from the main body, because the opening/closing portion is pressed against the periphery of the outlet when the main body is detached from the developing apparatus. Also, it is preferable that the opening/closing portion for the outlet has a ring shape concentric with the rotation center of the rotary element. By this configuration, it is possible to prevent toner leakage from the main body in the event of accidental rotation of the rotary element when the main body is detached from the developing apparatus, because the ring-shaped opening/closing portion keeps the outlet closed.

According to the third aspect of the present invention, the rotary element has an opening/closing portion for the outlet, and a means for pressing the opening/closing portion against the periphery of the outlet when the main body is detached from the developing apparatus is provided, wherein the opening/closing portion can be raised from the periphery of the outlet by pressing up the rotary element by the rotation driving element when the main body is attached to the developing apparatus. By this configuration, it is possible to prevent toner leakage from the main body, because the opening/closing portion is pressed against the periphery of the outlet when the main body is detached from the developing apparatus. By providing the rotary element with both the toner-collecting portion and the opening/closing portion to collect the toner by the rotation of the rotary element and to open the outlet by pressing up the rotary element by the rotation driving element, the toner-collecting mechanism and the outlet opening/closing mechanism share parts, resulting in a decreased number of parts, simplified assembly, and production cost reduction.

It is preferable that the toner-collecting portion of the toner cartridge of the present invention is in contact with the inner face of the main body and is elastically deformable according to the motion of the rotary element relative to the main body, whereby accurate toner collection is possible.

DETAILED DESCRIPTION OF PREFERRED EMBODIMENTS

First Embodiment

Figure 1:
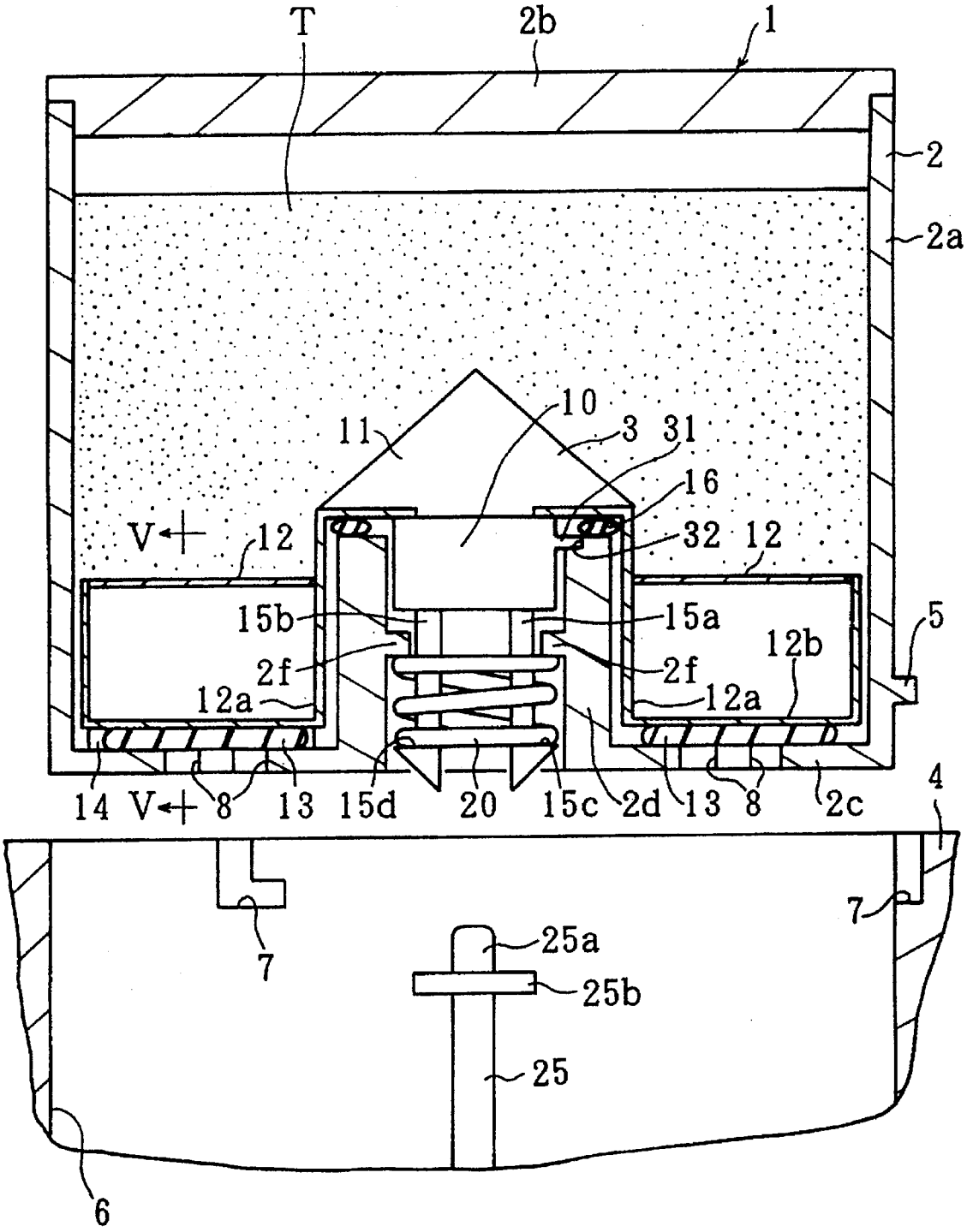
FIG. 1 is a cross-sectional view of the toner cartridge detached from the developing apparatus in the first embodiment of the present invention.

The first embodiment of the present invention is hereinafter described with reference to FIGS. 1 through 6.

The toner cartridge 1 illustrated in FIGS. 1 through 4 comprises a main body 2 and a rotary element 3 rotatably attached to the main body 2. The main body 2 has a cylindrical peripheral wall 2*a*, a lid element 2*b* for covering the upper opening of the peripheral wall 2*a*, a ring-shaped bottom wall 2*c* for covering the lower opening of the peripheral wall 2*a*, and a cylindrical support 2*d* extending upwardly from the inner periphery of the bottom wall 2*c*. Plural outlets 8 for the toner are formed in the bottom wall 2*c*. The toner T is fed in the main body 2 via the upper opening of the peripheral wall 2*a*, after this feeding, the lid element 2*b* is attached to the peripheral wall 2*a*. The toner T can be efficiently fed, because this feeding can be achieved via the entire upper opening of the peripheral wall 2*a*.

The main body 2 is attachable to and detachable from a developing apparatus 4 of a copying machine etc. Specifically, plural protrusions 5 are provided on the outer periphery of the peripheral wall 2*a* of the main body 2. In the upper inner periphery of a toner supply hole 6 formed in the developing apparatus 4, plural concavities 7, each having an L-shaped lateral view, are formed on the positions corresponding to the positions of the protrusions 5. After inserting the main body 2 into the toner supply hole 6 with inserting the protrusions 5 into the respective concavities 7, by rotating the main body 2 around the vertical axis, the main body 2 is supported by the inner face of each concavity 7 via each protrusion 5. When the main body 2 is attached to the developing apparatus 4, the above-described outlets 8 are faced downwardly.

The rotary element 3 has a column 10, a cone 11 unified to the upper portion of the column 10, a pair of blades 12 inserted between the column 10 and the cone 11, opening/closing portions 13 attached to the blades 12, toner-collecting portions 14 attached to the blades 12, and a pair of joints 15*a* and 15*b* extending downwardly from the column 10.

Figure 5:
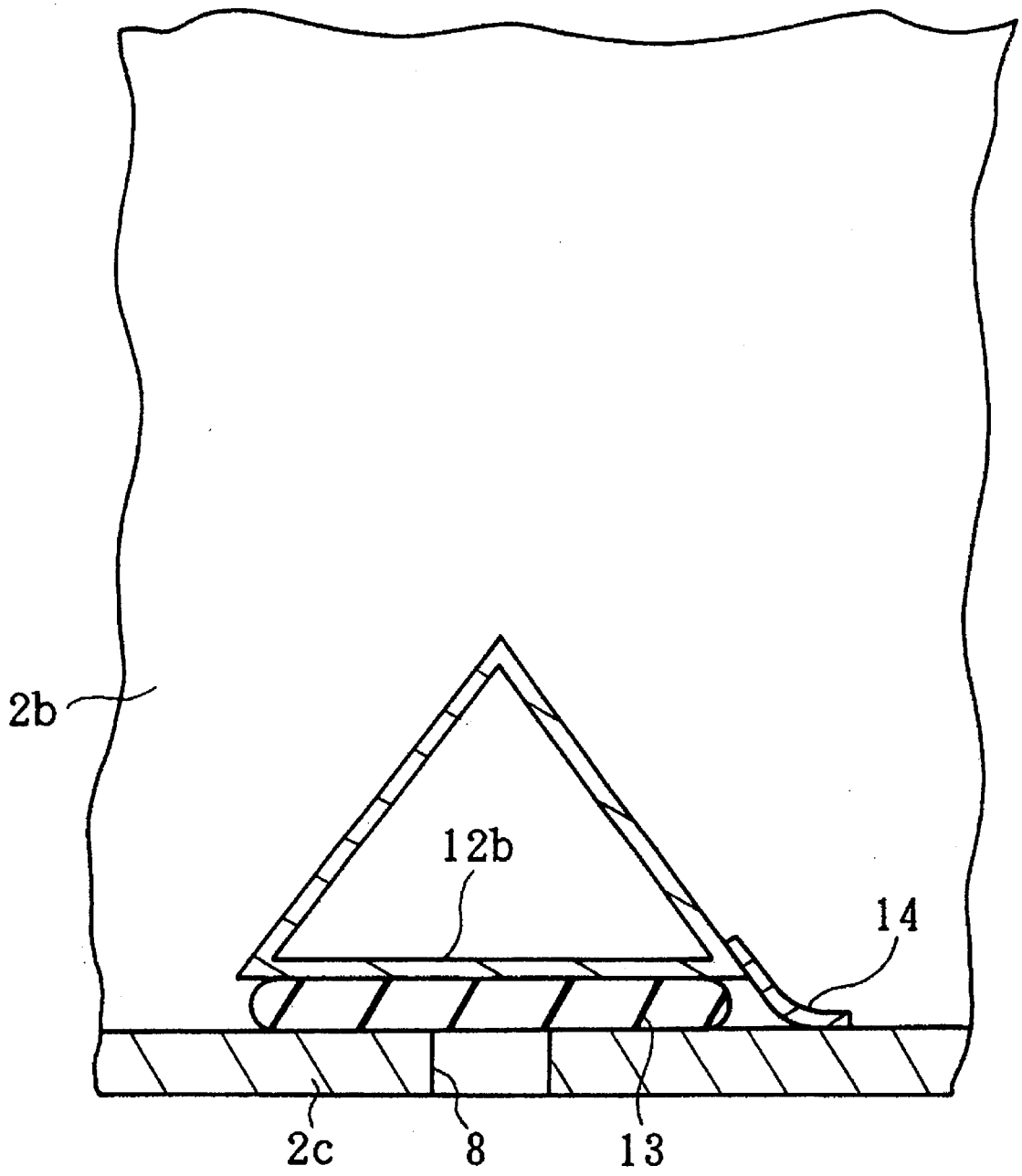
FIG. 5 is a cross-sectional view of FIG. 1 along the V—V line.

The column 10 is inserted into the above-described support 2*d*. A ring-shaped elastic sealing element 16 is present between the cone 11 and the support 2*d* to prevent the leakage of the toner T. Each blade 12, made of a plate-like material, has an inner portion 12*a* extending downwardly from the cone 11, and an outer portion 12*b* extending radially outwardly from the lower end of the inner portion 12*a*. As shown in FIG. 5, the upper face of the outer portion 12*b* is inclined against the horizon to prevent the deposition of the toner T.

Figure 3:
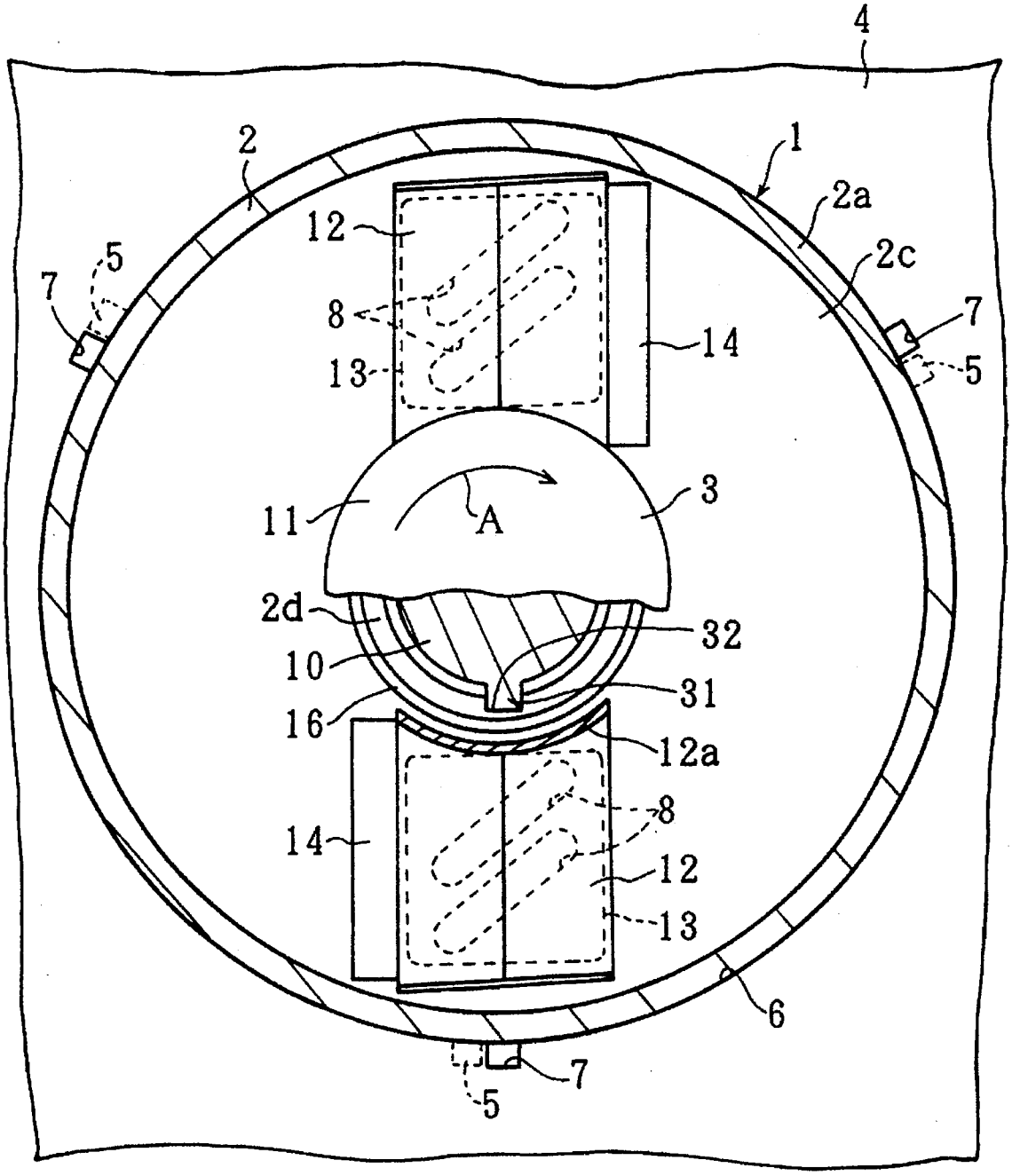
FIG. 3 is a plane cross-sectional view of the toner cartridge.
Figure 4A:
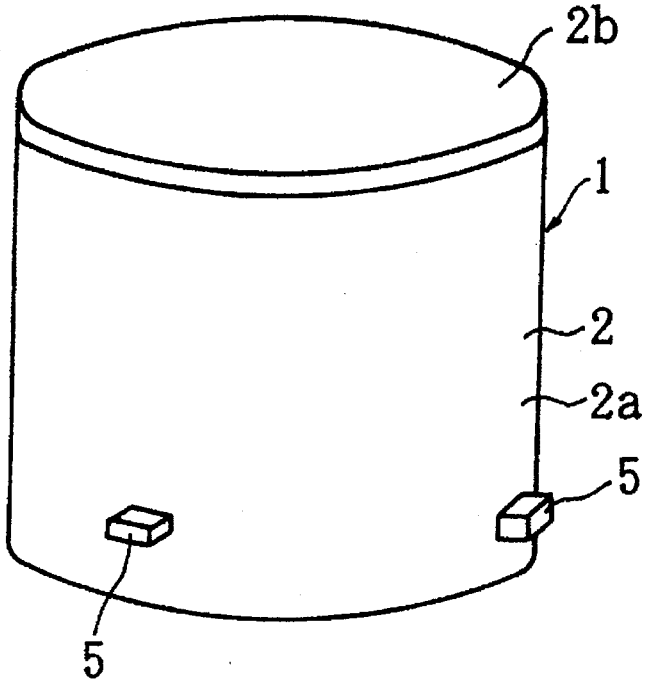
FIG. 4A is an oblique view of the toner cartridge.
Figure 4B:
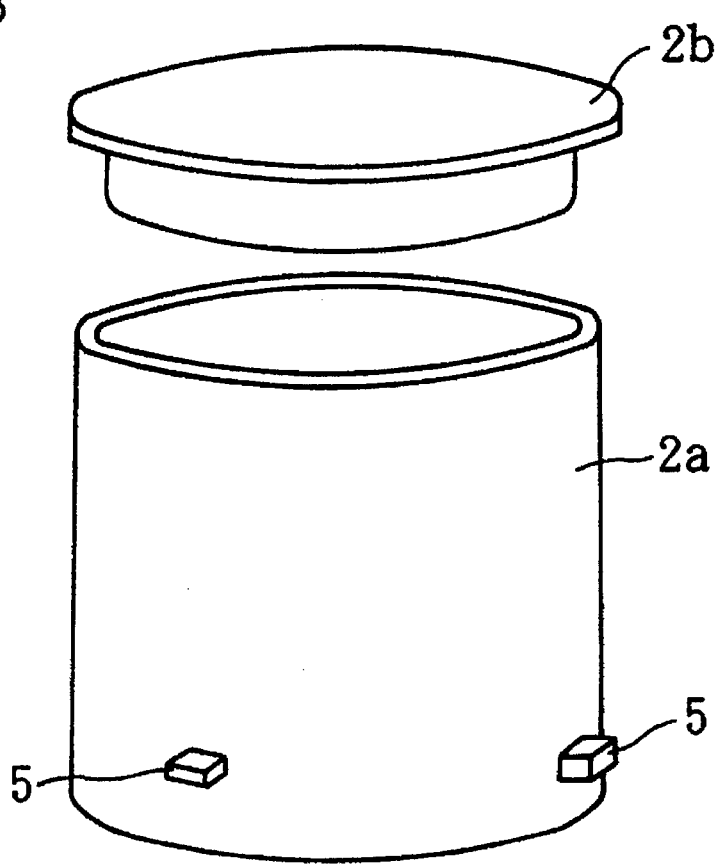
FIG. 4B is an oblique view of the toner cartridge with its lid detached.

Each toner-collecting portion 14 consists of a film attached to the outer portion 12*b* of each blade 12, as shown in FIGS. 3 and 5. The film is in contact with the horizontal upper face of the above-described bottom wall 2*c*, becoming crossed with the outlet 8 by the rotation of the rotary element 3 relative to the main body 2. The film is made of an elastically deformable material allowing its motion according to the vertical motion of the rotary element 3 relative to the main body 2.

Each opening/closing portion 13, made of an elastically deformable material such as urethane rubber, is attached to the lower face of the outer portion 12*b* of each blade 12.

Figure 2:
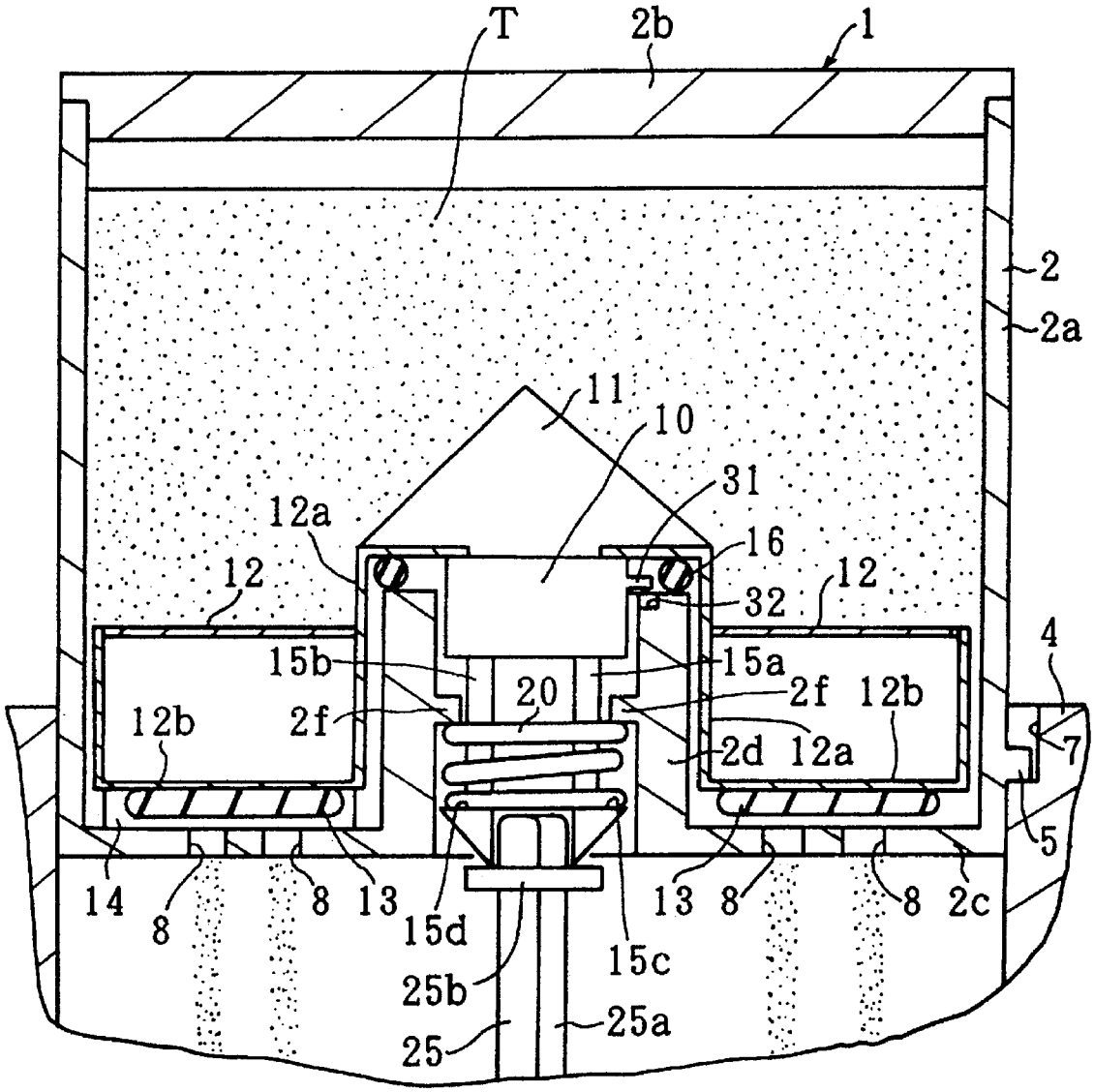
FIG. 2 is a cross-sectional view of the toner cartridge attached to the developing apparatus.
Figure 6:
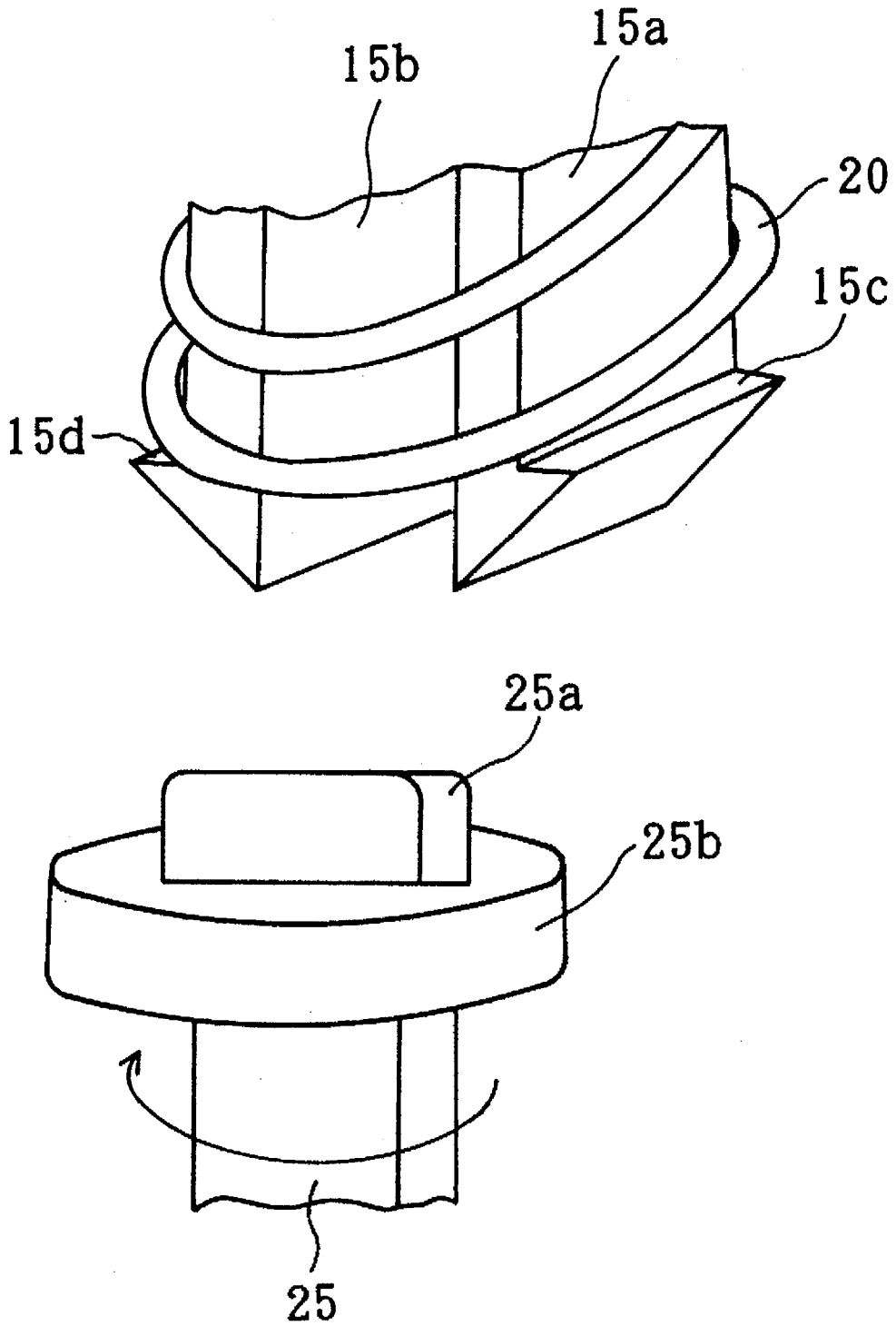
FIG. 6 is a partial oblique view of the toner cartridge.

As shown in FIGS. 1, 2 and 6, steps 15*c* and 15*d* are formed outside of the lower ends of the joints 15*a* and 15*b*. Also, a protrusion 2*f* is formed in the inner periphery face of the above-described support 2*d*. A compression coil spring 20 is fitted around the two joints 15*a* and 15*b*. The elastic force of the spring 20 is received by the steps 15*c* and 15*d* and the protrusion 2*f*. By the elastic force, the rotary element 3 is downwardly pressed against the main body 2, so that the opening/closing portions 13 are pressed against the periphery of the outlets 8 when the main body 2 is detached from the developing apparatus 4. The joints 15*a* and 15*b* are elastically movable so as to decrease their distance when they are inserted into the protrusion 2*f* and the spring 20 in the assembling process.

As shown in FIG. 2, when the main body 2 is attached to the developing apparatus 4, the joints 15*a* and 15*b* are connected to a rotation driving element 25 provided on the developing apparatus 4. The rotation driving element 25 has a rod 25*a* and a flange 25*b* extending from the outer periphery of the rod 25*a*. The plane view of the rod 25*a* is a rectangle, whose longer sides are longer than the distance between the two joints 15*a* and 15*b* and shorter sides are shorter than the distance between the two joints 15*a* and 15*b*. When the main body 2 is attached to the developing apparatus 4, the rod 25*a* is inserted into between the two joints 15*a* and 15*b*, and the flange 25*b* presses up the rotary element 3 via the lower ends of the two joints 15*a* and 15*b*. To allow insertion of the rod 25*a* into between the two joints 15*a* and 15*b*, the facing direction of the two joints 15*a* and 15*b* is set in a given direction relative to the protrusions 5 of the main body 2 when the opening/closing portions 13 close the outlets 8, and the direction of the longer sides of the rectangular plane view of the rotation driving element 25 is set in a given direction relative to the concavity 7 of the toner supply hole 6 when the rotation driving element 25 is not driven.

When the rotary element 3 is pressed up by the flange 25*b*, the opening/closing portions 13 are raised from the upper face of the bottom wall 2*c*, i.e., from the periphery of the outlets 8. The rotation driving element 25 is rotated a given predetermined number by times by a driving mechanism (not illustrated), then this rotation is transmitted to the rotary element 3 via the two joints 15*a* and 15*b*. The rotation driving element 25 can be activated via a starter switch, which acts in response to attaching of the main body 2 to the developing apparatus 4 or which is operated by an operator after the attaching. By the rotation of the rotary element 3, the opening/closing portions 13, which are raised from the periphery of the outlets 8, moves between a position above the outlets 8 and a position laterally distanced from the outlets 8. Also, by the rotation of the rotary element 3, the toner-collecting portions 14 collect the toner T housed in the main body 2.

A stopper 31 protrudes from the outer periphery of the column 10 of the rotary element 3. A concavity 32 is formed inside of the upper end of the support 2*d* of the main body 2. The stopper 31 is fitted into the concavity 32 when the rotary element 3 moves downwardly relative to the main body 2, this fitting prevents the rotation of the rotary element 3 relative to the main body 2. When the rotary element 3 moves upwardly relative to the main body 2, the stopper 31 leaves the concavity 32, allowing the rotation of the rotary element 3 relative to the main body 2. Because the rotary element 3 is downwardly pressed against the main body 2 by the elastic force of the above-described spring 20, the stopper 31 is forced to go to the rotation-preventing position. When the rotation driving element 25 presses up the rotary element 3 by attaching of the main body 2 to the developing apparatus 4, the stopper 31 moves to the rotation-allowing position.

According to the configuration described above, when the main body 2 is attached to the developing apparatus 4, the rotary element 3 is pressed up by the rotation driving element 25 and moves upwardly relative to the main body 2. This motion causes the opening/closing portions 13 to be raised from the upper face of the bottom wall 2*c*, i.e., from the periphery of the outlets 8, therefore, a part of the toner T housed in the main body 2 falls from the outlets 8 and is supplied to the developing apparatus 4. Also, the stopper 31 moves to the rotation-allowing position, and then the rotation driving element 25 is rotated, this rotation is transmitted to the rotary element 3 via the joints 15*a* and 15*b*. The rotary element 3 rotates in the direction of an arrow A in FIG. 3, and the toner-collecting portions 14 collect the toner T housed in the main body 2, then this toner collection stirs the toner T and introduces the toner T to the outlets 8 in the main body 2. Therefore, the toner T is smoothly discharged from the outlets 8. The rotation driving element 25 stops its motion after it has rotated a sufficient predetermined number of times to discharge the toner T. In this stopping condition, each opening/closing portion 13 is positioned above the outlet 8. When the main body 2 is detached from the developing apparatus 4, the rotary element 3 is moved downwardly relative to the main body 2 by the elastic force of the spring 20, so that the stopper 31 moves to a rotation-preventing position, and the opening/closing portions 13 are pressed against the periphery of the outlet's 8 with elastic deformation. Therefore, the fall of the toner T from the outlet 8 is certainly prevented.

Second Embodiment

Figure 7:
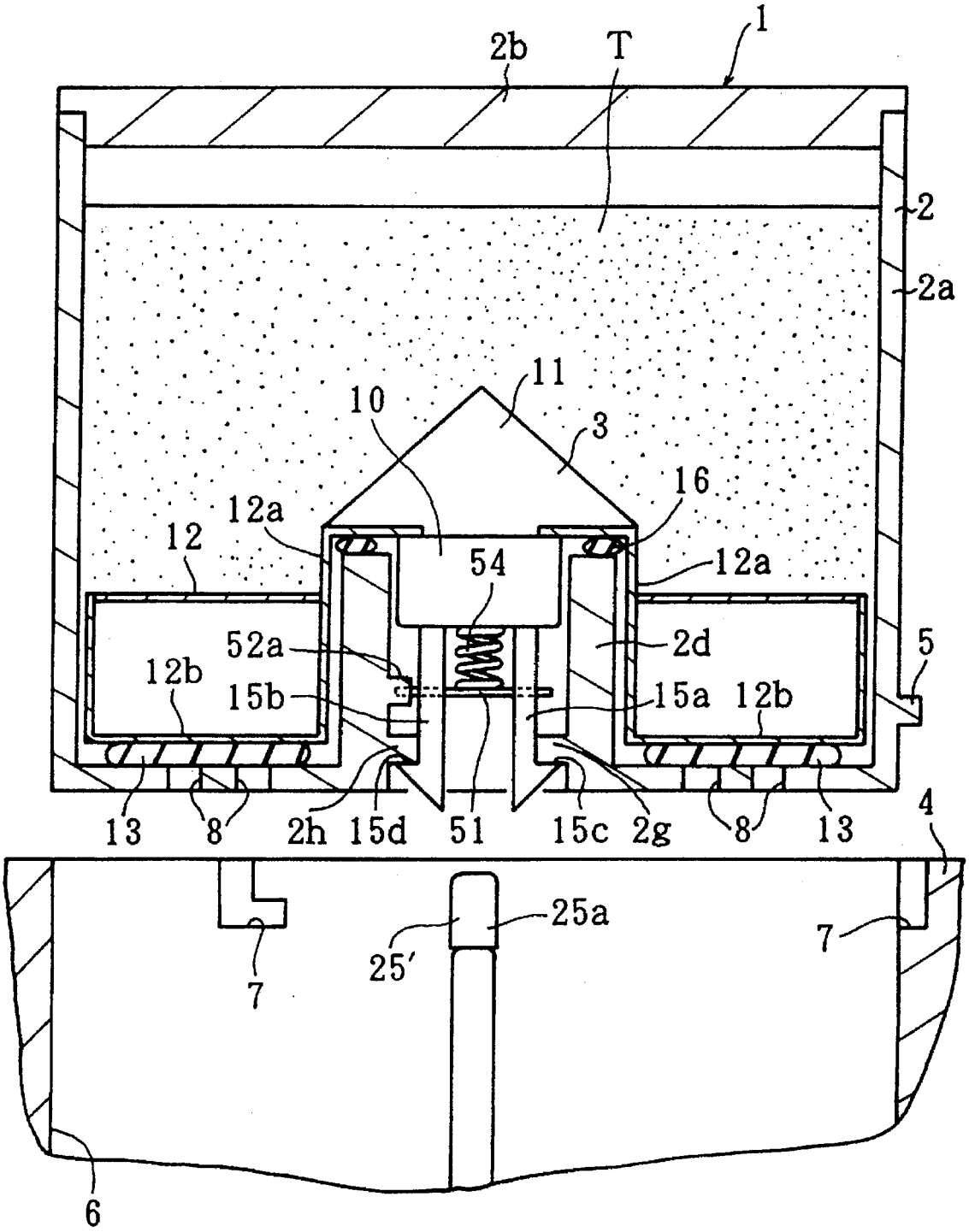
FIG. 7 is a cross-sectional view of the toner cartridge detached from the developing apparatus in the second embodiment of the present invention.
Figure 8:
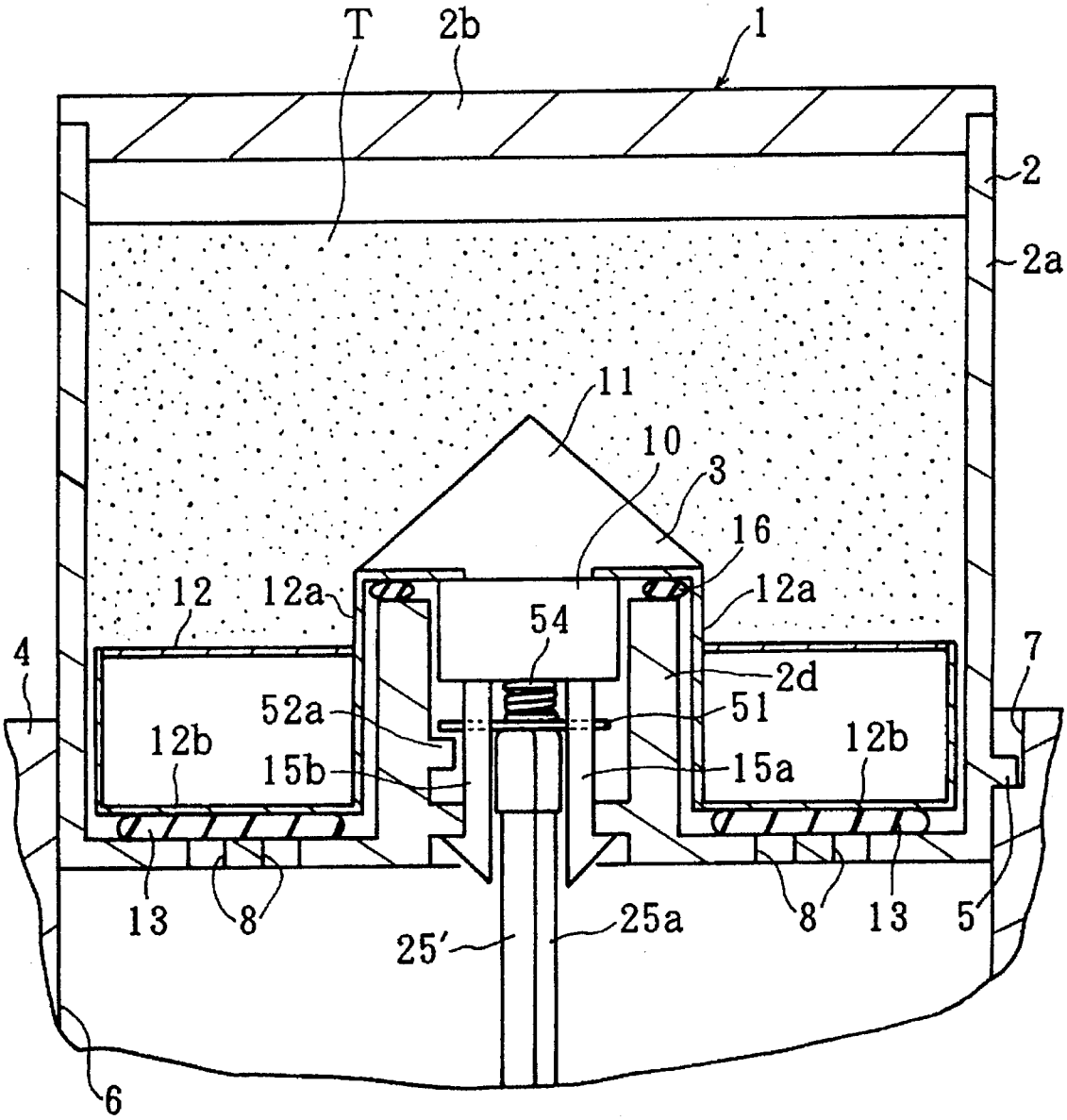
FIG. 8 is a cross-sectional view of the toner cartridge attached to the developing apparatus.
Figure 9:
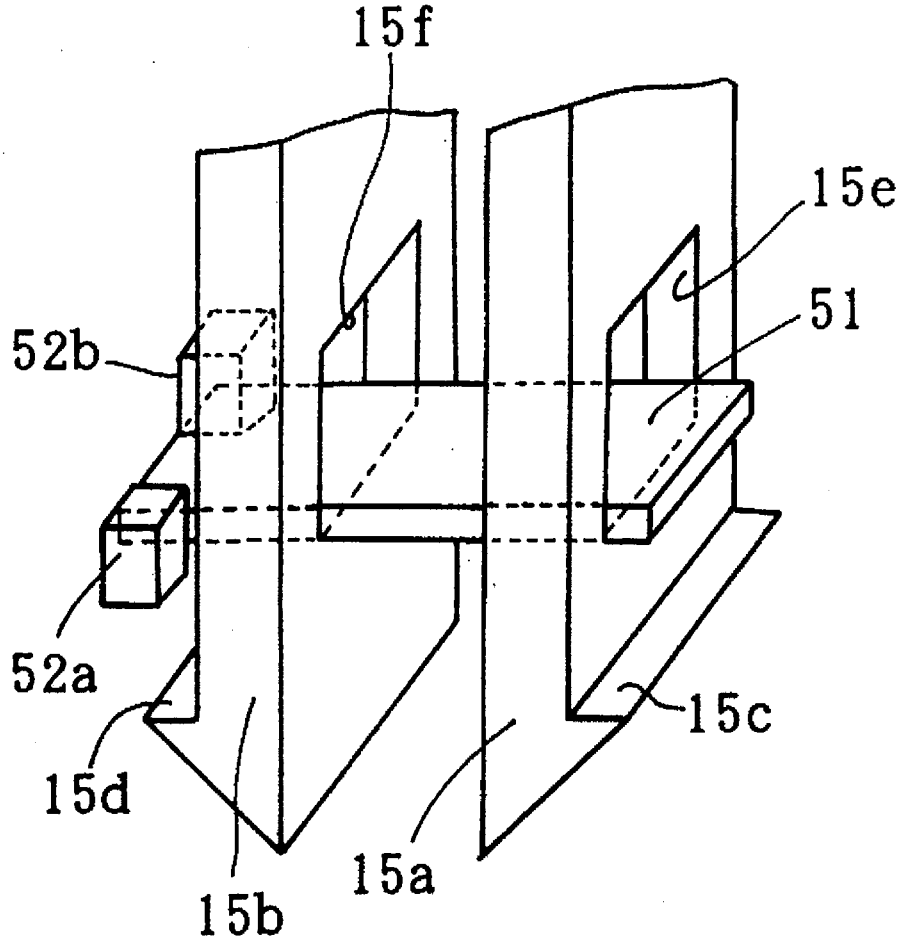
FIG. 9 is a partial oblique view of the toner cartridge.

The second embodiment of the present invention is hereinafter described with reference to FIGS. 7 through 9. The portions identical with those in the first embodiment are denoted by the same symbols; only different aspects are described.

In this second embodiment, a stopper 51 vertically movable relative to the main body 2 and relative to the rotary element 3 is provided, in place of the stopper 31 unified to the rotary element 3 of the first embodiment. Specifically, the stopper 51 is inserted into the supporting holes 15*e* and 15*f* (FIG. 9) formed in the two joints 15*a* and 15*b*, and is supported by the inner faces of the two supporting holes 15*e* and 15*f*. A pair of stopper receivers 52*a* and 52*b* (FIGS. 1 and 9) protruding from the inner face of the support 2*d* are unified to the main body 2. When the stopper 51 is positioned between the two stopper receivers 52*a* and 52*b*, the rotation of the rotary element 3 relative to the main body 2 is prevented. Between the stopper 51 and the column 10 of the rotary element 3, a compression coil spring 54 is placed. By the elastic force of the compression coil spring 54, the stopper 51 is forced to go to the rotation-preventing position. The stopper 51 is pressed up by the rotation driving element 25' when the main body 2 is attached to the developing apparatus 4, moving to above the two stopper receivers 52*a* and 52*b*, whereby the stopper 51 moves to a position allowing the rotation of the rotary element 3 relative to the main body 2.

The rotation driving element 25' does not have the flange 25*b* of the first embodiment, it has a rod 25*a* alone, and does not press up the rotary element 3, whereby the opening/closing portions 13 are not raised from the upper face of the bottom wall 2*e*. That is, the opening/closing portions 13 can collect the toner T by moving between a position above the outlets 8 and a position laterally distanced from the outlets 8 by the rotation of the rotary element 3, without being raised from the periphery of the outlets 8. In other words, the opening/closing portions 13 serve as toner-collecting portions, in place of the film-made toner-collecting portions of the first embodiment.

In this second embodiment, there is no spring 20 of the first embodiment for forcing the rotary element 3 to go downwardly to the main body 2. Instead, the steps 15*c* and 15*d* in the lower ends of the joints 15*a* and 15*b* are hooked on protrusions 2*g* and 2*h* formed in the inner peripheral face of the support 2*d*, whereby the sealing element 16 is elastically compressed and the opening/closing portions 13 are pressed against the periphery of the outlets 8. The other aspects of the second embodiment are the same as in the first embodiment.

According to the second embodiment, when the main body 2 is attached to the developing apparatus 4, the stopper 51 is pressed up by the rotation driving element 25', then moves to the rotation-allowing position. Rotation of the rotation driving material 25' is then transmitted to the rotary element 3 via the joints 15*a* and 15*b*. By this rotation of the rotary element 3, the opening/closing portions 13 are moved between a position above the outlets 8 and a position laterally distanced from the outlets 8. When the opening/closing portions 13 are moved to the position laterally distanced from the outlets 8, the toner T falls from the outlets 8 and is supplied to the developing apparatus 4. Furthermore, by rotation of the rotary element 3, the opening/closing portions 13, which serve as toner-collecting portions, collect the toner T in the main body 2. This toner collection stirs the toner T and introduces the toner T to the outlets 8 in the main body 2, so that the toner T is smoothly discharged from the outlet 8. The rotation driving element 25' stops its motion, when it has rotated a sufficient predetermined number of times to discharge the toner T. In this stopping condition, the opening/closing portions 13 are located at the position above the outlets 8 to prevent the fall of the toner T from the outlets 8.

Third Embodiment

Figure 10:
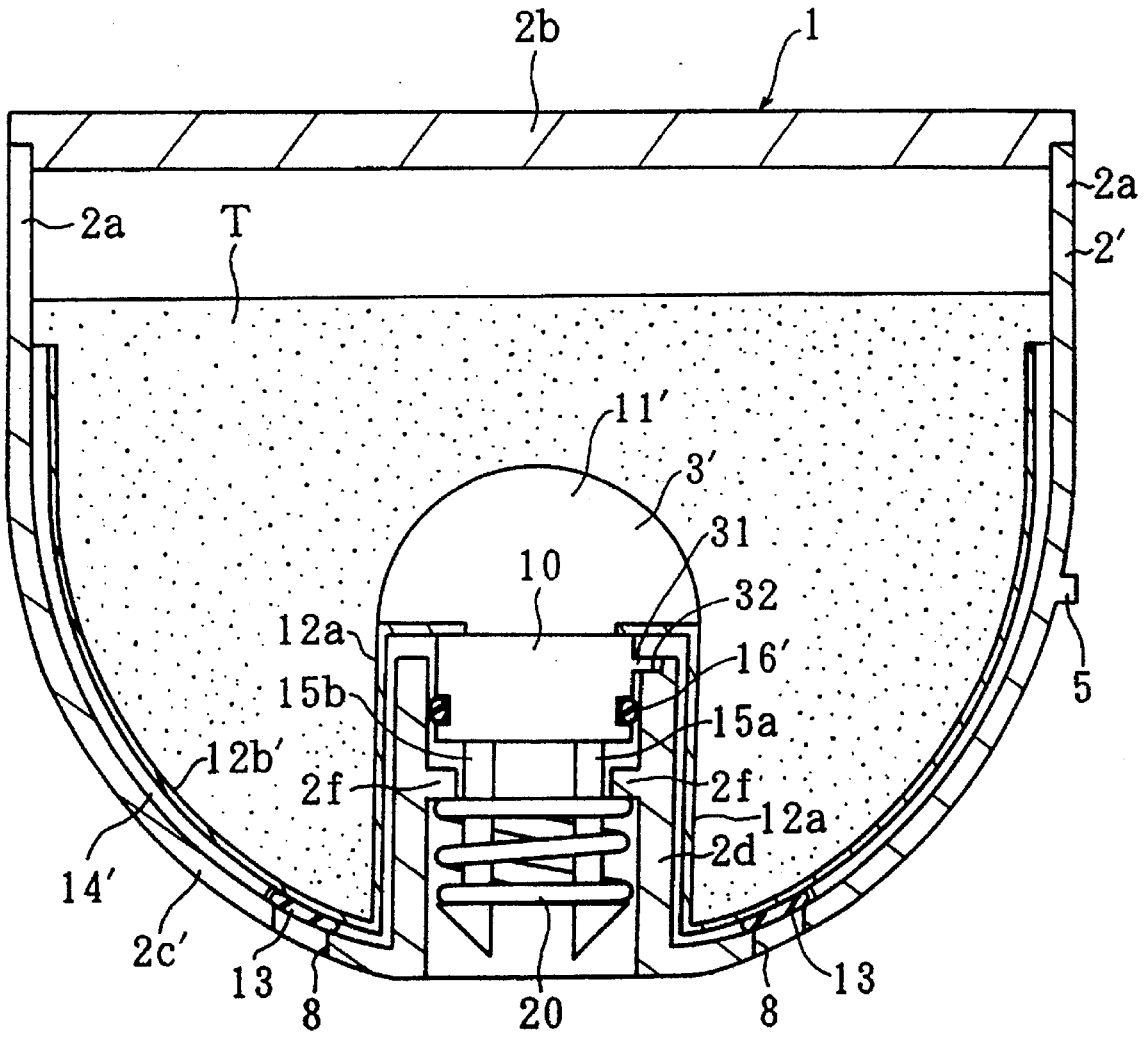
FIG. 10 is a cross-sectional view of the toner cartridge detached from the developing apparatus in the third embodiment of the present invention.

FIG. 10 shows the toner cartridge of the third embodiment of the present invention. The portions identical with those in the first embodiment are denoted by the same symbols, only different aspects are described. The bottom wall 2*c'* of the main body 2' has a shape along a sphere. The outer portion 12*b'* of each blade 12 of the rotary element 3' is curved along the bottom wall 2*c'*. The toner-collecting portions 14' do not cross the toner outlets 8. In place of the cone 11 of the first embodiment, a hemisphere 11' constitutes the rotary element 3'. In place of the sealing element 16 of the first embodiment, a ring-shaped sealing element 16' is present between the column 10 and the support 2*d*. The other aspects are the same as in the first embodiment.

Fourth Embodiment

Figure 11:
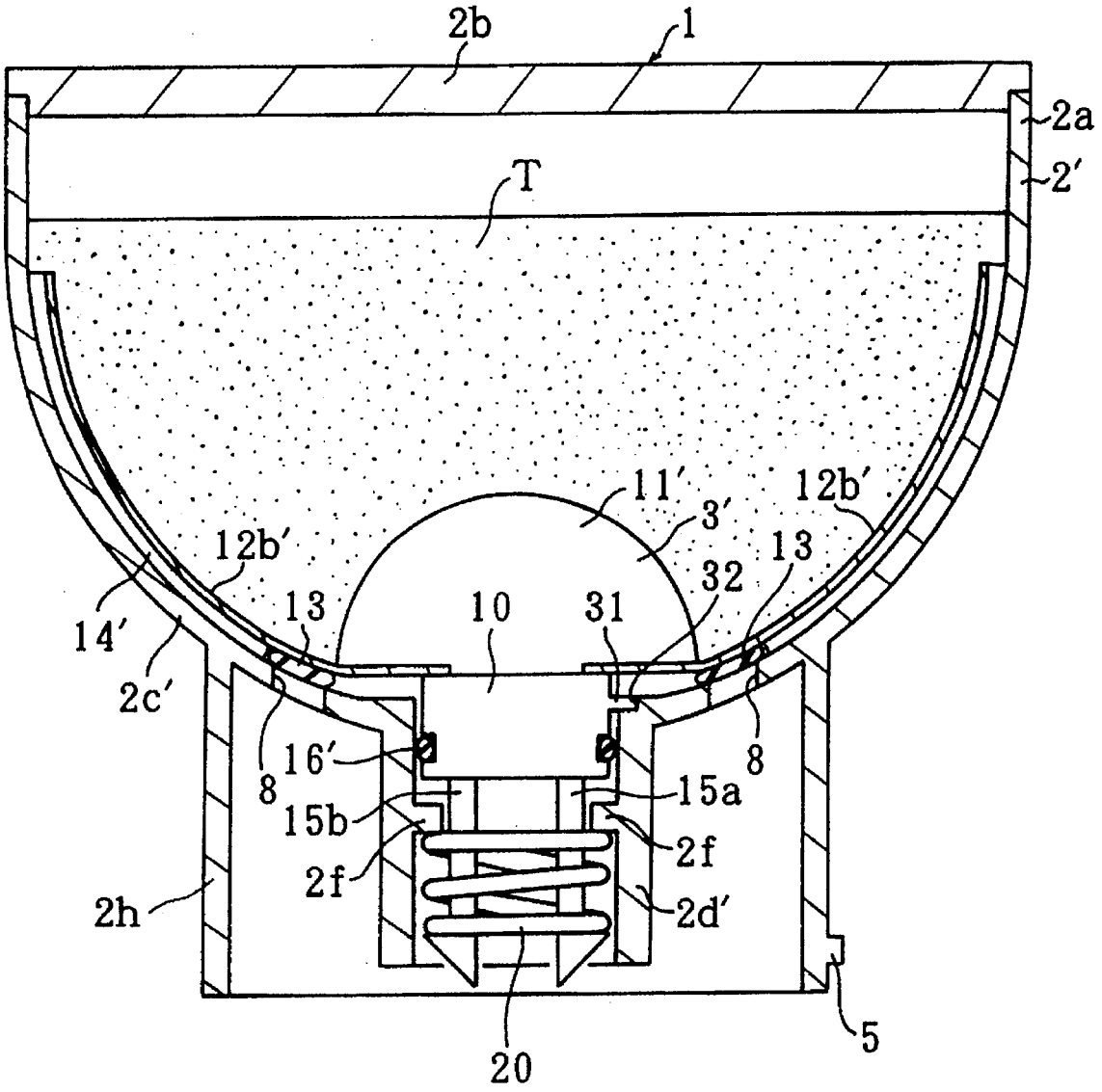
FIG. 11 is a cross-sectional view of the toner cartridge detached from the developing apparatus in the fourth embodiment of the present invention.
Figure 12:
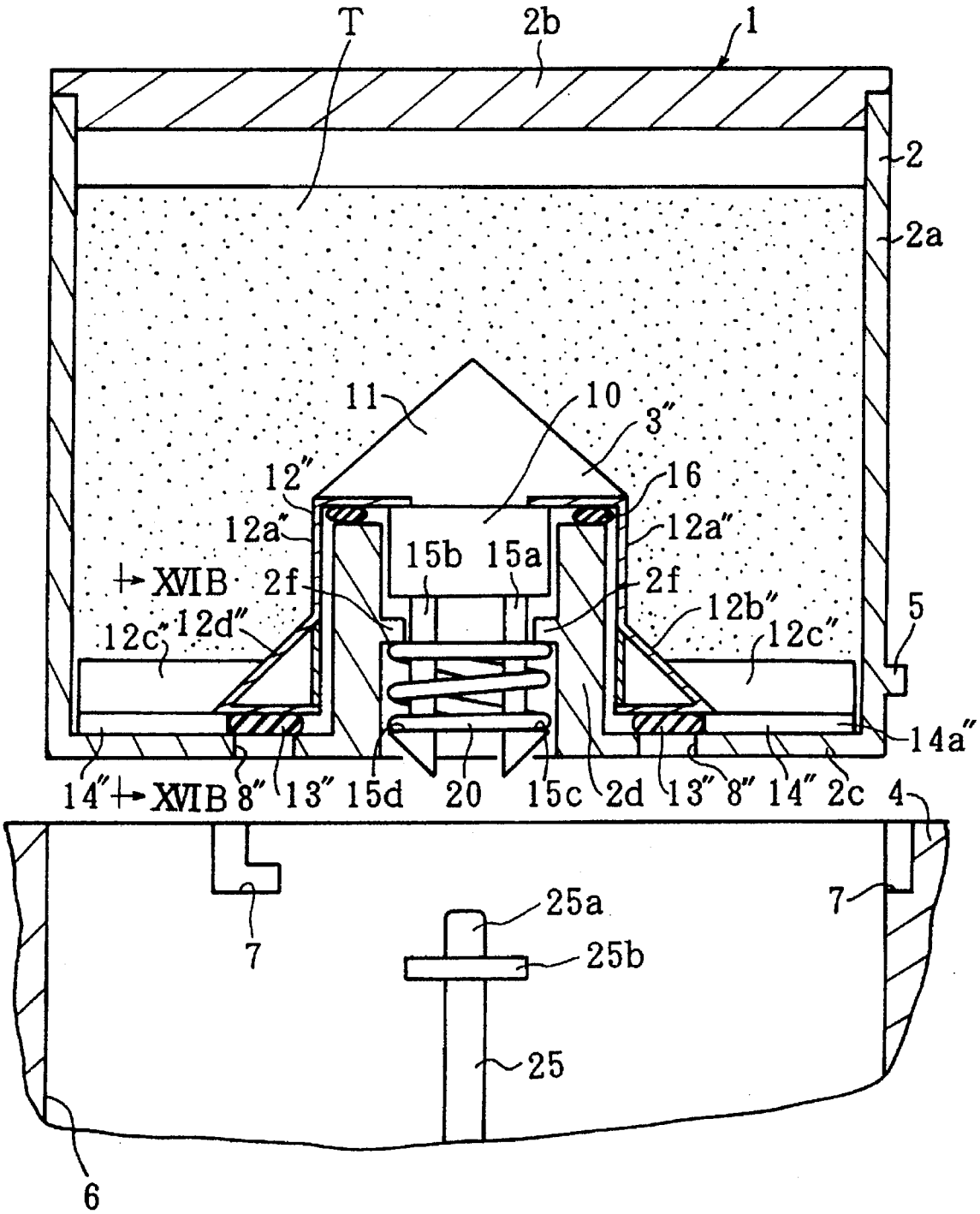
FIG. 12 is a cross-sectional view of the toner cartridge detached from the developing apparatus in the fifth embodiment of the present invention.

FIG. 11 shows the toner cartridge of the fourth embodiment of the present invention. The portions identical with those in the first and third embodiments are denoted by the same symbols, only different aspects are described. In contrast to the above-described third embodiment in which the support 2*d* of the main body 2' extends upwardly from the inner periphery of the bottom wall 2*c'*, the support 2*d'* of this fourth embodiment extends downwardly from the inner periphery of the bottom wall 2*c'*. A cylinder 2*h* surrounding the support 2*d'* extends downwardly from the bottom wall 2*c'*. The outlets 8 are placed between the support 2*d'* and the column 2*h*. The protrusions 5 are provided in the outer periphery of the cylinder 2*h*. The other aspects are the same as in the third embodiment.

Fifth Embodiment

The fifth embodiment of the present invention is hereinafter described with reference to FIGS. 12 through 17. The portions identical with those in the first embodiment are denoted by the same symbols; only different aspects are described.

In the toner cartridge 1 of the fifth embodiment, plural outlets 8" for the toner are formed along the inner periphery of the bottom wall 2*c* in the bottom wall 2*c* of the main body 2.

Figure 14:
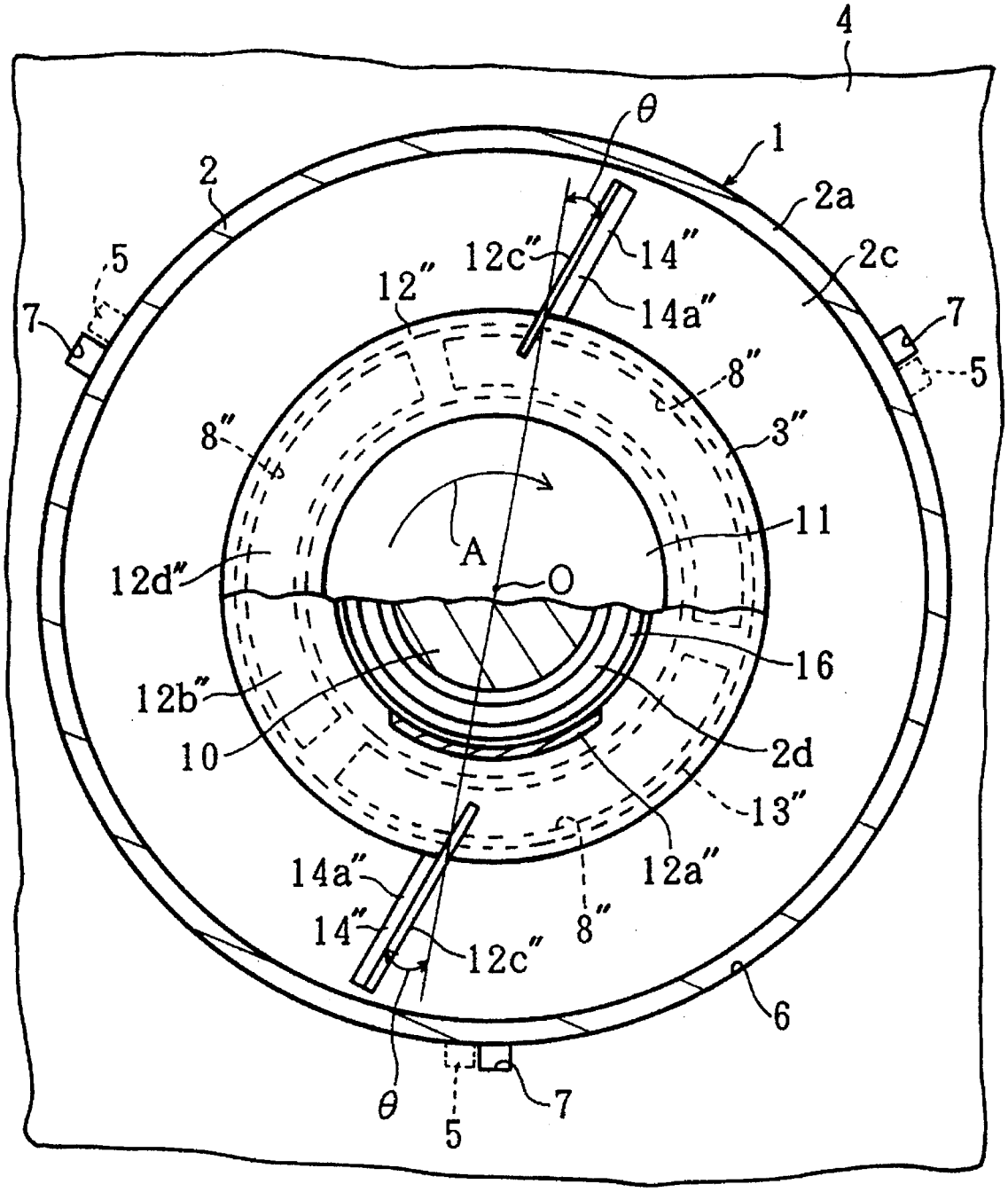
FIG. 14 is a plane cross-sectional view of the toner cartridge.
Figure 15A:
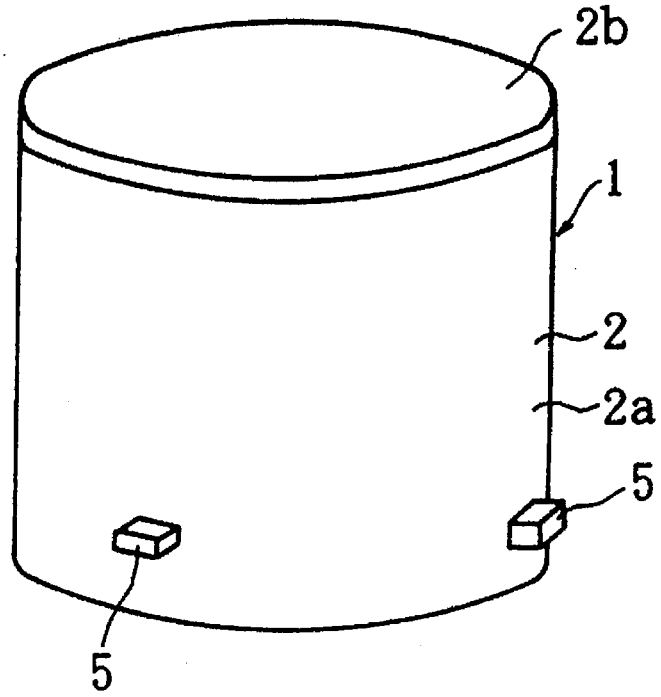
FIG. 15A is an oblique view of the toner cartridge.
Figure 15B:
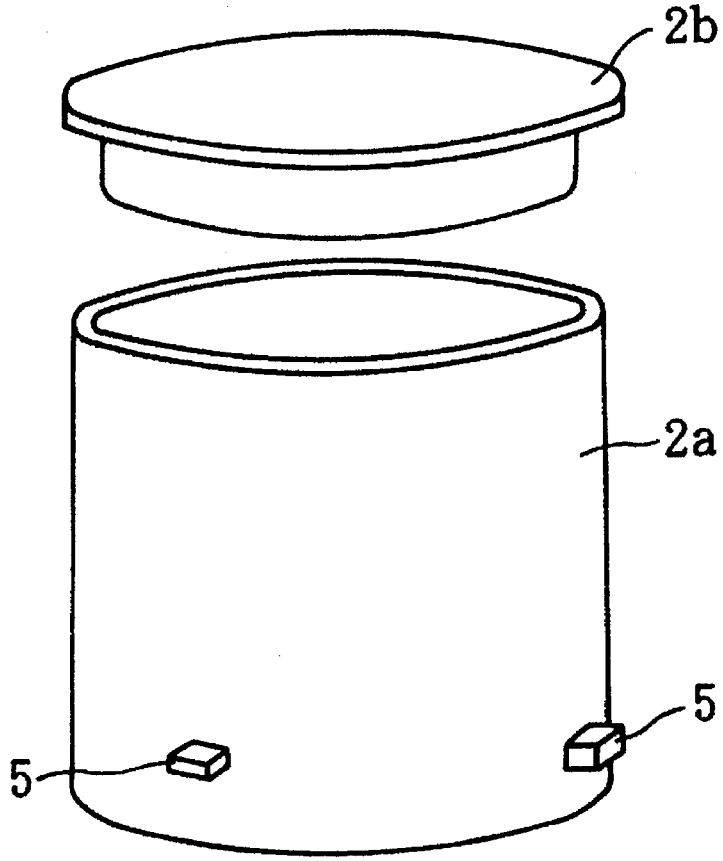
FIG. 15B is an oblique view of the toner cartridge with its lid detached.
Figure 16A:
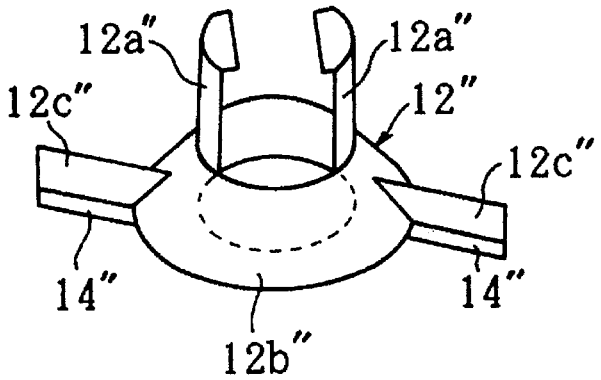
FIG. 16A is an oblique view of the rotary element retaining portion of the toner cartridge.

The rotary element 3" of this fifth embodiment has a column 10, a cone 11 unified to the upper portion of the column 10, a retaining portion 12" surrounding the column 10, an opening/closing portion 13" attached to the retaining ring 12" and toner-collecting portions 14" attached to the retaining portion 12", and a pair of joints 15*a* and 15*b* extending downwardly from the column 10. The retaining portion 12" is made of a plate-like material and has a pair of joint portions 12*a"* whose upper ends are inserted between the column 10 and the cone 11, an annular portion 12*b"* connected to the lower ends of the two joint portions 12*a"*, and a pair of blades 12*c"* extending outwardly from the annular portion 12*b"* as shown in FIG. 16A. The upper face 12*d"* of the annular portion 12*b"* is inclined against the horizon to prevent the deposition of the toner T. Each toner-collecting portion 14" is made of a film attached to each blade 12*c"* and is always in contact with the upper face of the bottom wall 2*c* of the main body 2. As shown in FIG. 14, each toner-collecting face 14*a"* of the toner-collecting portions 14" is inclined at an angle of θ as indicated by the Figure against the radial direction of rotation of the rotary element 3", so that the toner T is moved radially inwardly by the rotation and introduced to the above-described outlets 8" formed along the inner periphery side of the bottom wall 2*c*.

Figure 16B:
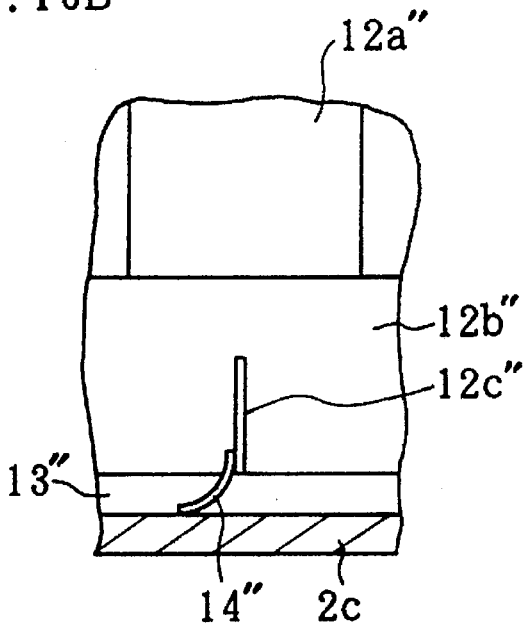
FIG. 16B is a cross-sectional view of FIG. 12 along the XVIB—XVIB line.
Figure 16C:
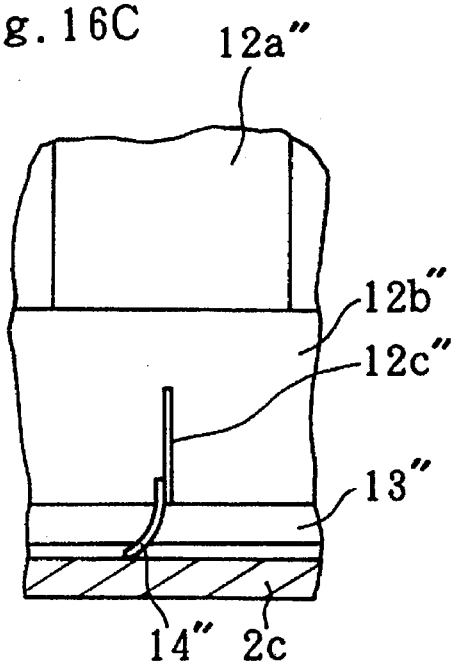
FIG. 16C is a cross-sectional view of FIG. 13 along the XVIC—XVIC line.
Figure 17:
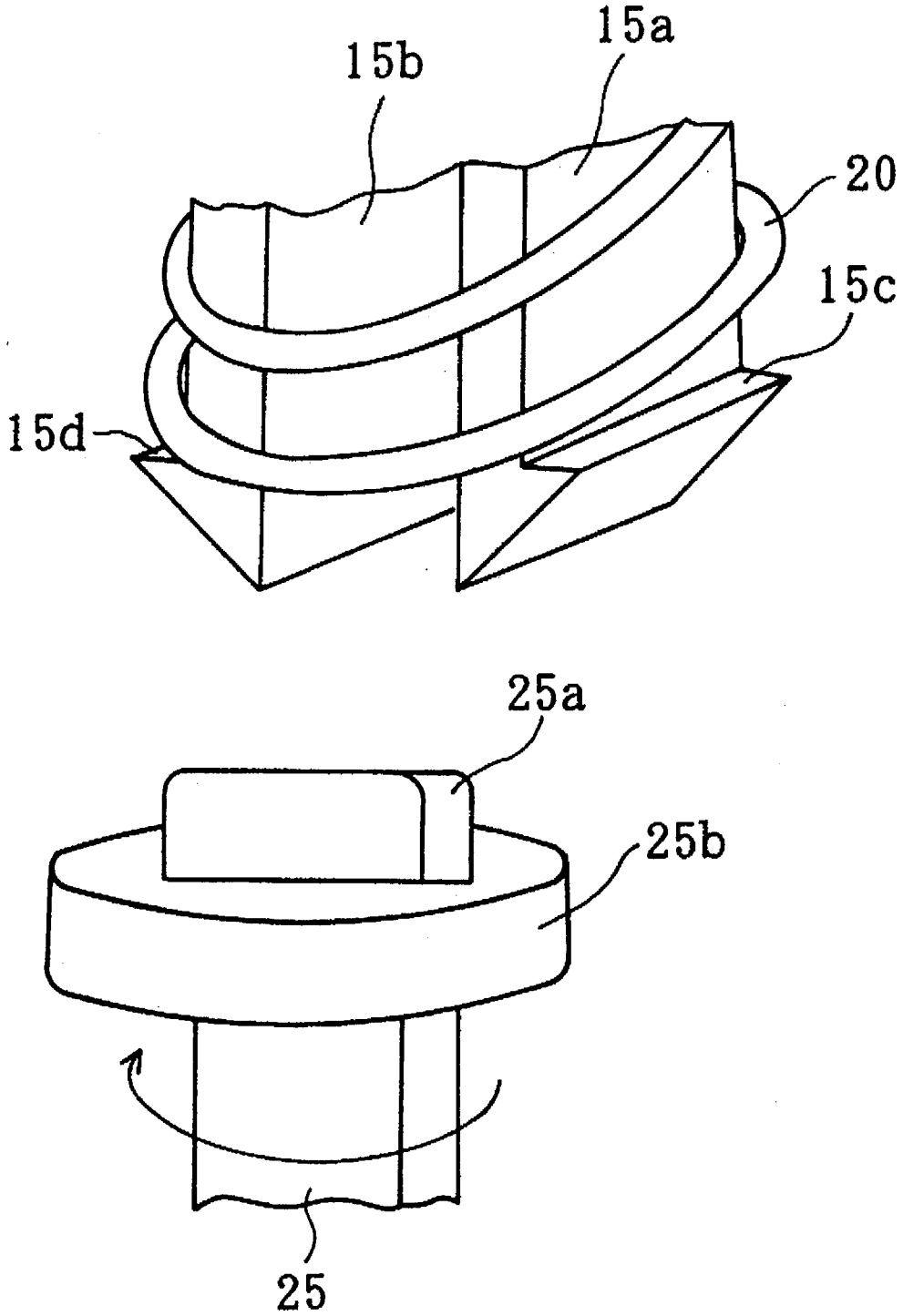
FIG. 17 is a partial oblique view of the toner cartridge.
Figure 18:
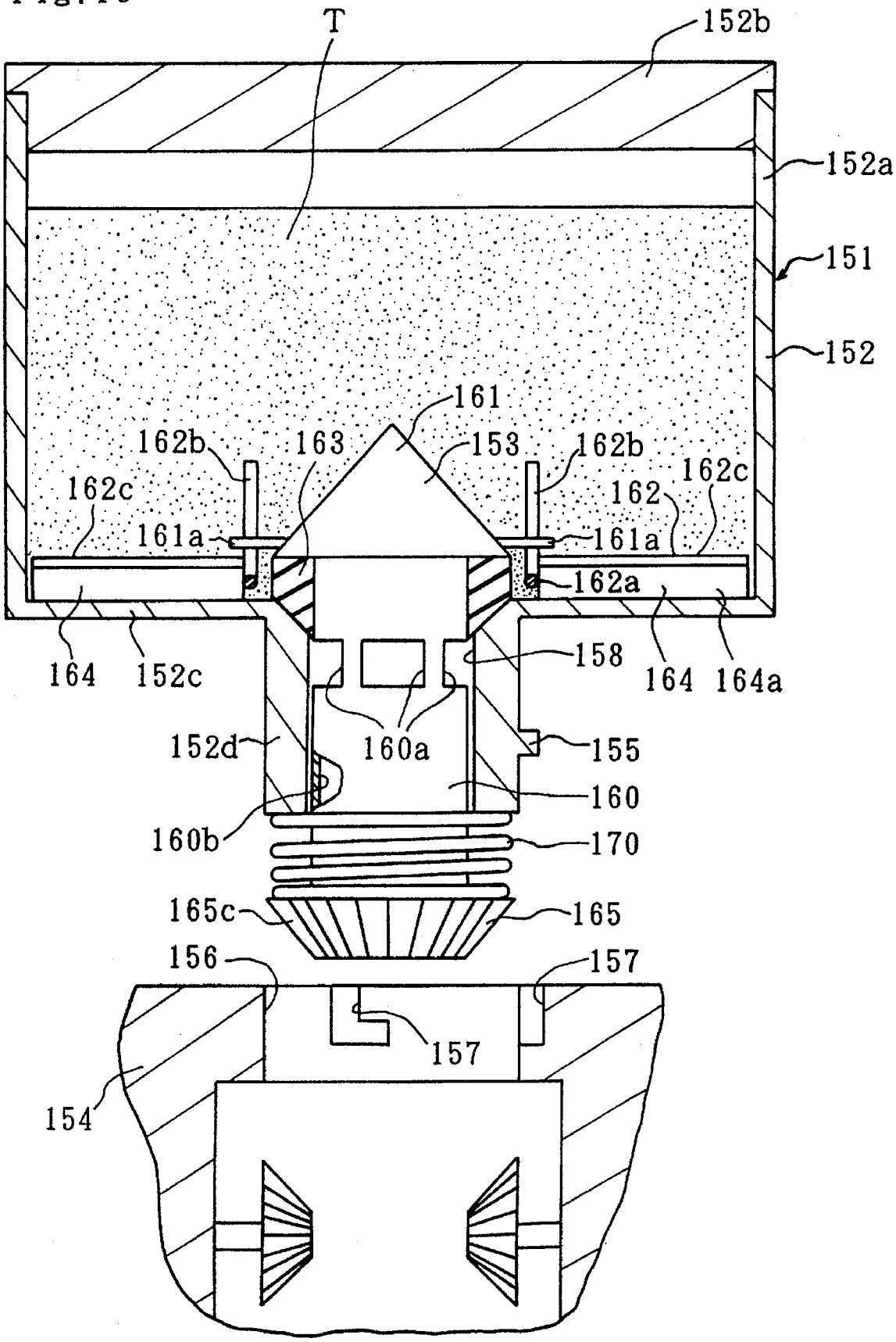
FIG. 18 is a cross-sectional view of the toner cartridge detached from the developing apparatus in the sixth embodiment of the present invention.

That is, each toner-collecting face 14*a*" goes forwardly along the circumferential direction of the rotation as it goes outwardly along the radial direction of the rotation. The film constituting the toner-collecting portions 14" is made of an elastically deformable material allowing its motion according to the motion of the rotary element 3" relative to the main body 2, whereby each toner-collecting portion 14" is in contact with the upper face of the bottom wall 2*c* whether the rotary element 3" is moved downwardly as shown in FIG. 16B or the rotary element 3 is moved upwardly as shown in FIG. 16C.

Figure 13:
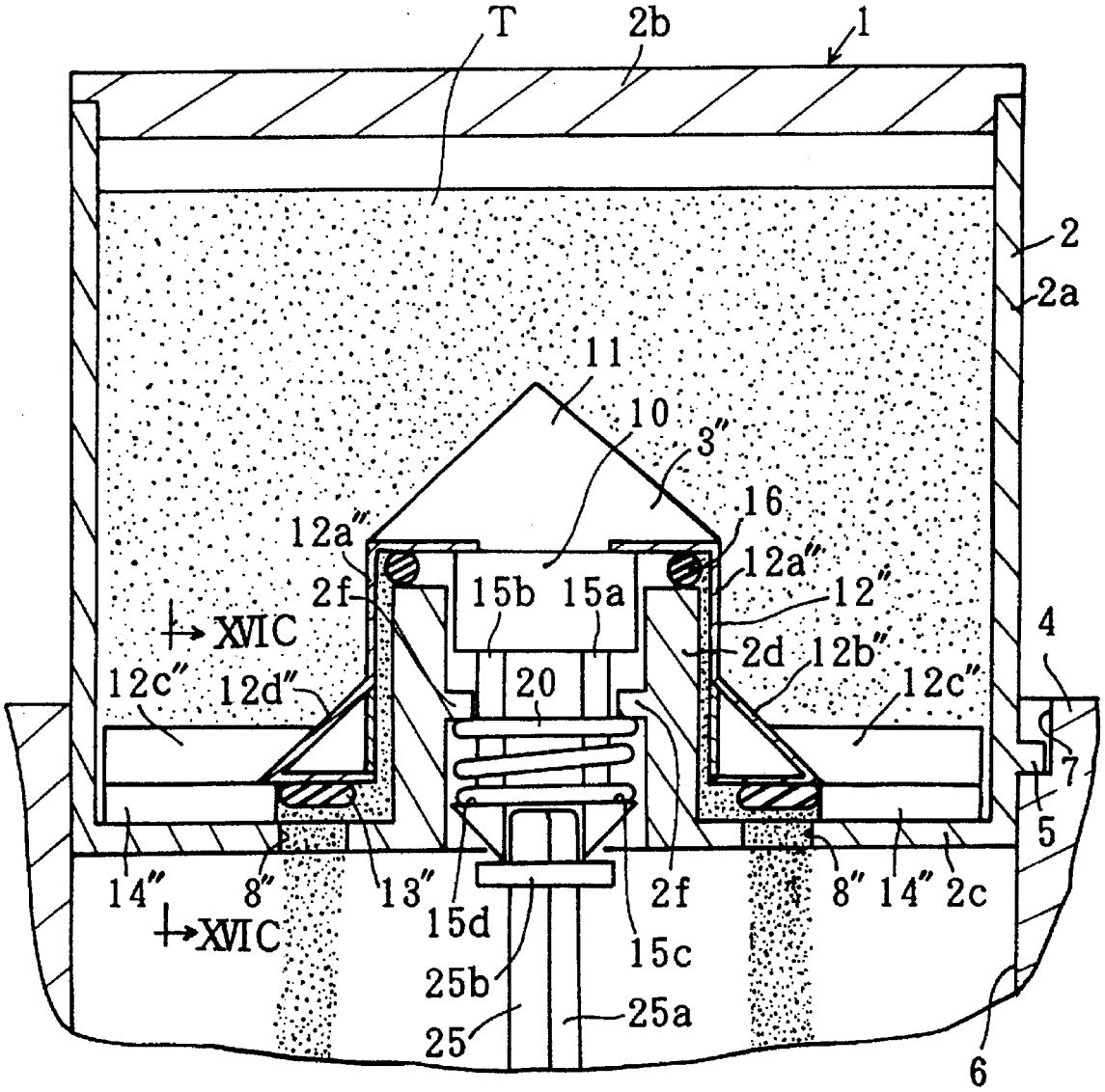
FIG. 13 is a cross-sectional view of the toner cartridge attached to the developing apparatus.

As shown in FIG. 14, the opening/closing portion 13" of this fifth embodiment has a ring shape concentric with the rotation center O of the rotary element 3". The opening/closing portion 13" is attached to the lower face of the annular portion 12*b*" of the above-described retaining portion 12 and is made of an elastically deformable material such as urethane rubber. This opening/closing portion 13" is raised from the upper face of the bottom wall 2*c*, namely from the periphery of the outlets 8", as shown in FIG. 13, when the rotary element 3" is pressed up by the flange 25*b* of the rotation driving element 25. The other aspects are the same as in the third embodiment.

According to the above-described configuration of the fifth embodiment, when the main body 2 is attached to the developing apparatus 4, the rotary element 3 is pressed up by the rotation driving element 25 and is moved upwardly relative to the main body 2, so that the opening/closing portion 13" is raised from the periphery of the outlets 8", whereby a part of the toner T in the main body 2 falls from the outlets 8" and is supplied to the developing apparatus 4. Next, the rotation of the rotation driving element 25 is transmitted to the rotary element 3" via the joints 15*a* and 15*b*, so that the rotary element 3" rotates in the direction of arrow A in FIG. 14. By the rotation of the rotary element 3", the toner-collecting portions 14" radially inwardly move the toner T housed in the main body 2 and introduce the toner T to the outlets 8", whereby the toner T falls from the outlets 8" and is supplied to the developing apparatus 4. Because each toner-collecting portion 14" is made of a film elastically deformable according to the motion of the rotary element 3" relative to the main body 2, and because it is always in contact with the inner face of the main body 2, the toner T can be certainly collected. The rotation driving element 25 stops its motion, when it has rotated a sufficient predetermined number of times to discharge the toner T. When the main body 2 is detached from the developing apparatus 4, the rotary element 3" is moved downwardly relative to the main body 2 by the elastic force of the spring 20, and the opening/closing portion 13" is pressed against the periphery of the outlets 8" and elastically deformed, whereby the fall of the toner T from the outlets 8" is certainly prevented. Because the opening/closing portion 13" and the toner-collecting portions 14" are provided in the rotary element 3", the toner T collecting mechanism and the outlet 8" opening/closing mechanism share parts, resulting in a decreased number of parts and simplified assembly. Because the opening/closing portion 13" has a ring shape concentric with the rotation center O of the rotary element 3", the outlets 8" are kept closed by the opening/closing portion 13" so as to prevent the toner T from leaking from the main body 2 in the event of accidental rotation of the rotary element 3" when the main body 2 is detached from the developing apparatus 4.

Sixth Embodiment

The sixth embodiment of the present invention is hereinafter described with reference to FIGS. 18 through 21.

The toner cartridge 151 of the sixth embodiment comprises a main body 152 and a rotary element 153 rotatably attached to the main body 152. The main body 152 has a cylindrical peripheral wall 152*a*, a lid element 152*b* for covering the upper opening of the peripheral wall 152*a*, a ring-shaped bottom wall 152*c* for covering the lower opening of the peripheral wall 152*a*, and a cylindrical support 152*d* extending downwardly from the inner periphery of the bottom wall 152*c*. The lower end of the toner cartridge 151 is removably covered by a cover 191. The inner periphery hole of the support 152*d* constitutes an outlet 158 for the toner. The toner T housed in the main body 152 is fed via the upper opening of the peripheral wall 152*a*, after this feeding the lid element 152*b* is attached to the peripheral wall 152*a*. The toner T can be efficiently fed, because it can be achieved from the entire upper opening of the peripheral wall 152*a*.

The main body 152 is attachable to and detachable from a developing apparatus 154 of a copying machine etc. Specifically, plural protrusions 155 are provided in the outer periphery of the support 152*d* of the main body 152. In the upper inner periphery of a toner supply hole 156 formed in the developing apparatus 154, plural concavities 157, each having an L-shaped lateral view, are formed corresponding to the positions of the protrusions 155. After inserting the support 152*d* into the toner supply hole 156 with inserting the protrusions 155 into the respective concavities 157, by rotating the main body 152 around the vertical axis, the main body 152 is supported by the inner face of each concavity 157 via each protrusion 155. When the main body 152 is attached to the developing apparatus, the above-described outlet 158 is faced downwardly.

The rotary element 153 has a cylinder 160, a cone 161 unified to the upper portion of the cylinder 160, a joint 165 unified to the lower portion of the cylinder 160, an opening/closing portion 163 unified to the outer periphery of the cylinder 160, a retaining portion 162 vertically movably joined to the cylinder 160, and toner-collecting portions 164 attached to the retaining portion 162.

The cylinder 160 is inserted into the inner periphery hole of the above-described support 152*d*, namely into the outlet 158, and has plural windows 160*a* in the outer periphery thereof. The inner periphery hole 160*b* of the cylinder 160 communicates with the outlet 158 via the windows 160*a*. The retaining portion 162 has a ring 162*a* surrounding the cylinder 160, a pair of rods 162*b* extending upwardly from the ring 162*a*, and blades 162*c* extending outwardly from the respective rods 162*b*. The rods 162*b* are vertically movably inserted into a pair of brackets 161*a* extending from the above-described cone 161.

Each toner-collecting portion 164 is made of a film attached to each blade 162*c*, and is in contact with the upper face of the bottom wall 152*c* of the main body 152. The contact face 164*a* of each toner-collecting portion 164 with the toner T is inclined against the radial direction of the rotation of the rotary element 163, as in the fifth embodiment, so that the toner T is moved radially inwardly by the rotation and introduced to the outlet 158. That is, the contact face 164*a* of the toner-collecting portion 164 with the toner T goes forwardly along the circumferential direction of the rotation as it goes outwardly along the radial direction of the rotation. The film constituting each toner-collecting portion 164 is made of an elastically deformable material allowing its motion according to the motion of the rotary element 153 relative to the main body 152, whereby each toner-collecting portion 164 is always kept in contact with the upper face of the bottom wall 152*c* even if the retaining portion 162 moves vertically according to the vertical motion of the rotary element 153.

The opening/closing portion 163, made of an elastically deformable material such as urethane rubber, has a ring shape concentric with the rotation center of the rotary element 153.

The joint 165 is cylindrical and has an inner periphery hole 165*a* communicates with the inner periphery hole 160*b* of the cylinder 160. A bevel gear 165*c* which is formed in the outer periphery of the joint 165. A compression coil spring 170 is fitted to the outer periphery of the lower portion of the cylinder 160. Since the elastic force of the spring 170 is received by the upper face of the joint 165 and the lower face of the above-described support 152*d* when the main body 152 is detached from the developing apparatus 154, the rotary element 153 is forced to go downwardly relative to the main body 152, and the opening/closing portion 163 is pressed against the upper face of the support 152*d* around the outlet 158.

Figure 19:
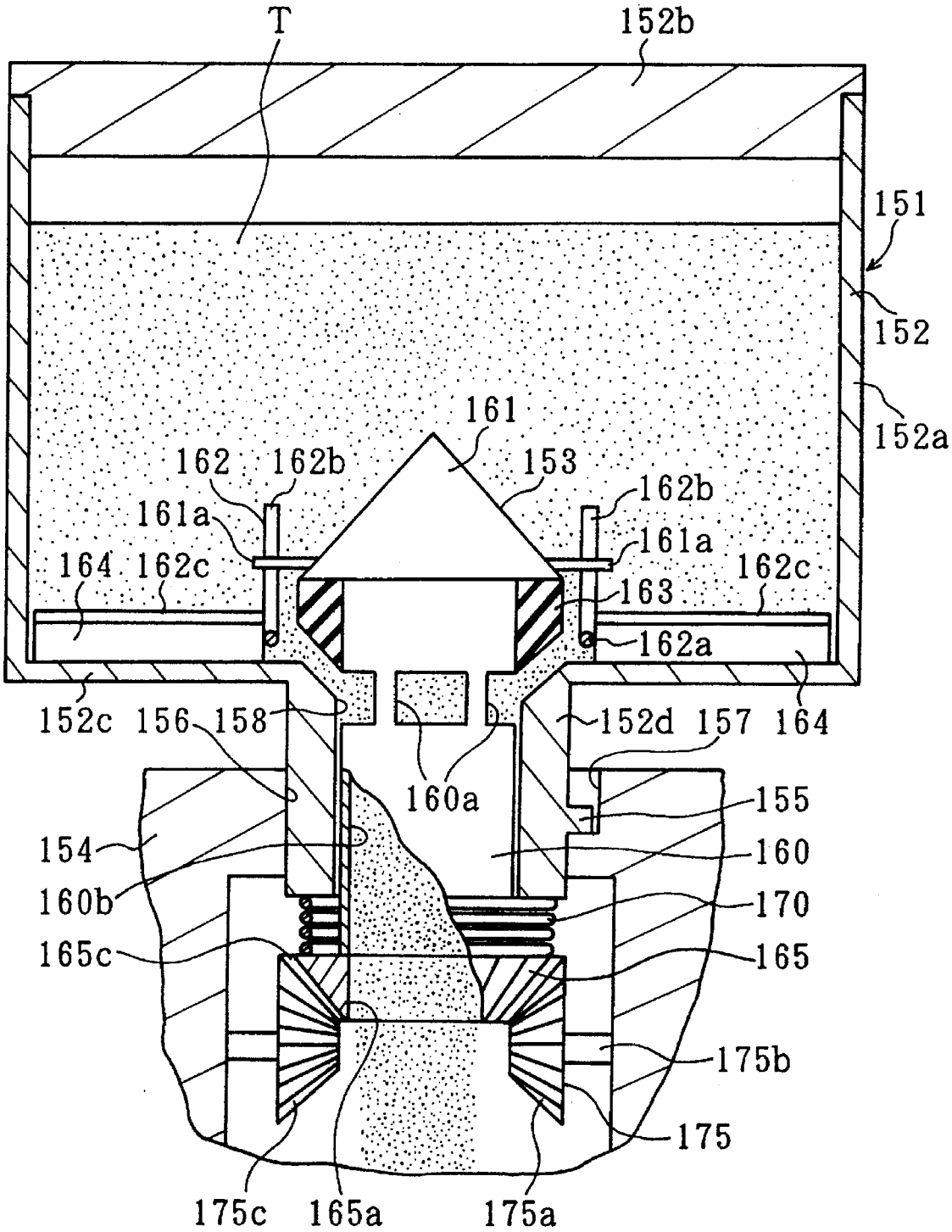
FIG. 19 is a cross-sectional view of the toner cartridge attached to the developing apparatus.
Figure 20:
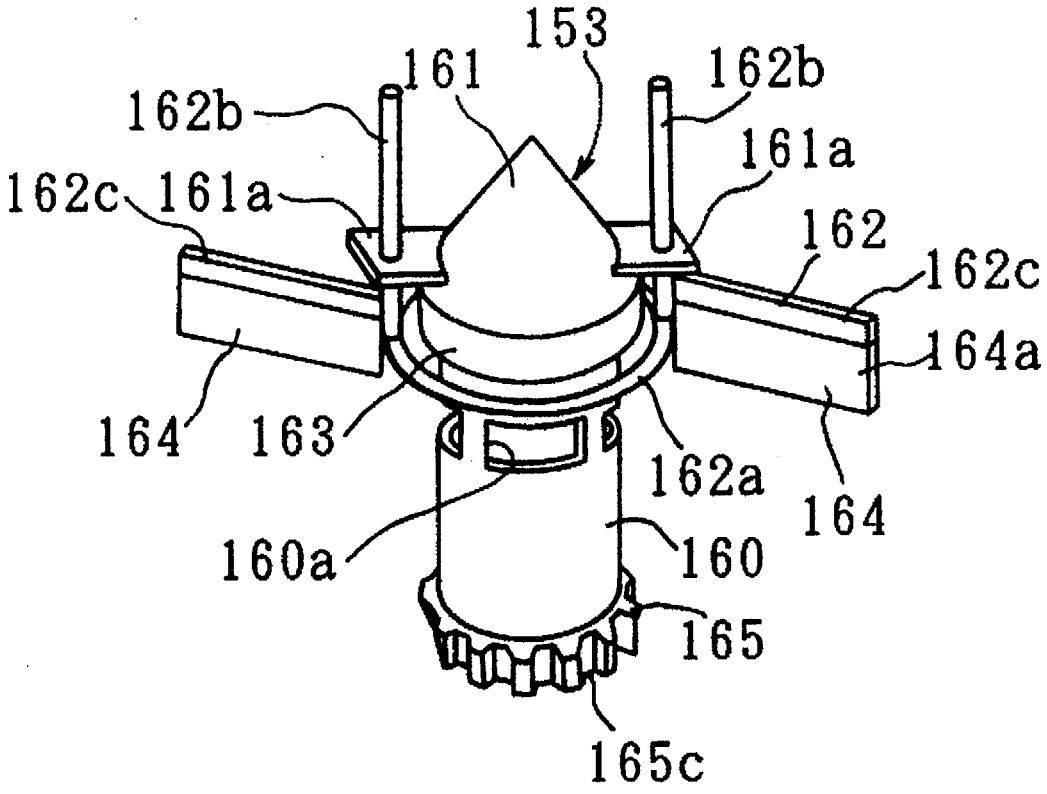
FIG. 20 is an oblique view of the rotary element of the toner cartridge.
Figure 21:
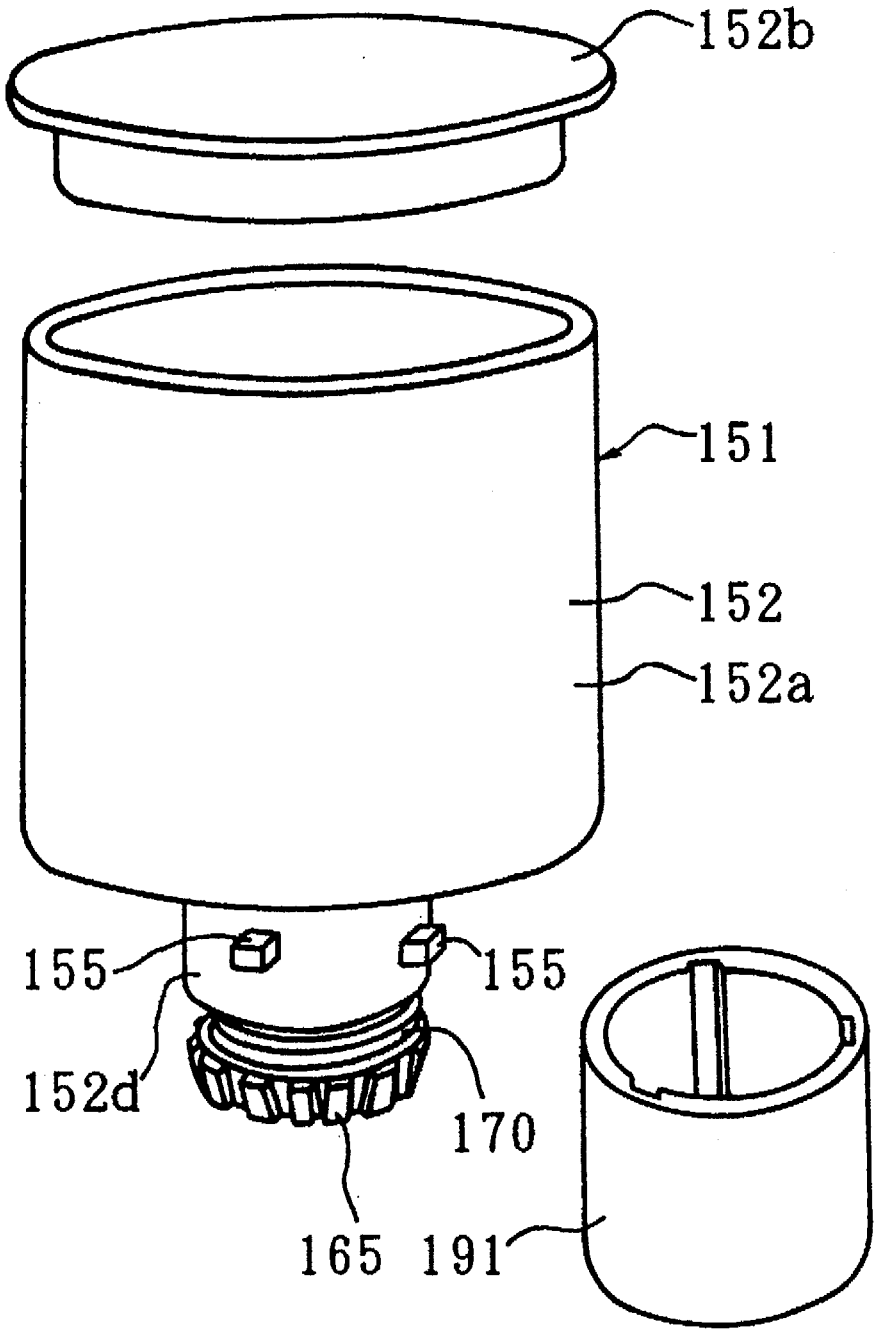
FIG. 21 is an oblique view of the toner cartridge.

As shown in FIG. 19, when the main body 152 is attached to the developing apparatus 154, the joint 165 is joined to a rotation driving element 175 provided on the developing apparatus 154. The rotation driving element 175 has a bevel gear 175*a* and a driving shaft 175*b* joining the bevel gear 175*a* to the rotation driving mechanism (not illustrated). On the developing apparatus 154, an auxiliary bevel gear 175*c* is rotatably attached. When the main body 152 is attached to the developing apparatus 154, the bevel gear 175*a* and the auxiliary bevel gear 175*c* mesh with the bevel gear 165*c* of the joint 165, and presses up the rotary element 153 via the joint 165. This pressing-up motion causes the opening/closing portion 163 to be raised from the periphery of the outlet 158.

When the main body 152 is attached to the developing apparatus 154, the rotation driving element 175 is rotated a given predetermined number of times by the rotation driving mechanism (not illustrated), this rotation is transmitted to the rotary element 153 via the joint 165. The rotation driving element 175 can be activated via a starter switch which acts upon sensing of attaching of the main body 152 to the developing apparatus 154 or which is operated by an operator after the attaching. By the rotation of the rotary element 153, the toner-collecting portions 164 collects the toner T housed in the main body 152.

According to the above-described configuration of the sixth embodiment, when the main body 152 is attached to the developing apparatus 154, the rotary element 153 is pressed up by the rotation driving element 175 and moved upwardly relative to the main body 152, and the opening/closing portion 163 is raised from the periphery of the outlet 158, whereby a part of the toner T in the main body 152 falls from the outlet 158 and is supplied to the developing apparatus 154. Next, the rotation of the rotation driving element 175 is transmitted to the rotary element 153 via the joint 165. By the rotation of the rotary element 153, the toner-collecting portions 164 radially inwardly move the toner T housed in the main body 152 and introduce the toner T to the outlet 158, whereby the toner T falls from the outlet 158 and is supplied to the developing apparatus 154 via the window 160*a* of the cylinder 160, the inner periphery hole 160*b* of the cylinder 160, and the inner periphery hole 165*a* of the joint 165. Because each toner-collecting portion 164 is made of a film elastically deformable according to the motion of the rotary element 153 relative to the main body 152, and is always in contact with the inner face of the main body 152, the toner T can be certainly collected. The rotation driving element 175 stops its motion when it has rotated a sufficient predetermined number of times to discharge the toner T. When the main body 152 is detached from the developing apparatus 154, the rotary element 153 is moved downwardly relative to the main body 152 by the elastic force of the spring 170, and the opening/closing portion 163 is pressed against the periphery of the outlet 158 and is elastically deformed, whereby the fall of the toner T from the outlet 158 is certainly prevented. Because the opening/closing portion 163 and the toner-collecting portions 164 are provided in the rotary element 153, the toner collecting mechanism and the outlet opening/closing mechanism share parts, resulting in a decreased number of parts and simplified assembly. Because the opening/closing portion 163 has a ring shape concentric with the rotation center of the rotary element 153, the outlet 158 is kept closed by the opening/closing portion 163 to prevent the toner T from leaking from the main body 152 in the event of accidental rotation of the rotary element 153 when the main body 152 is detached from the developing apparatus 154.

Seventh Embodiment

Figure 22:
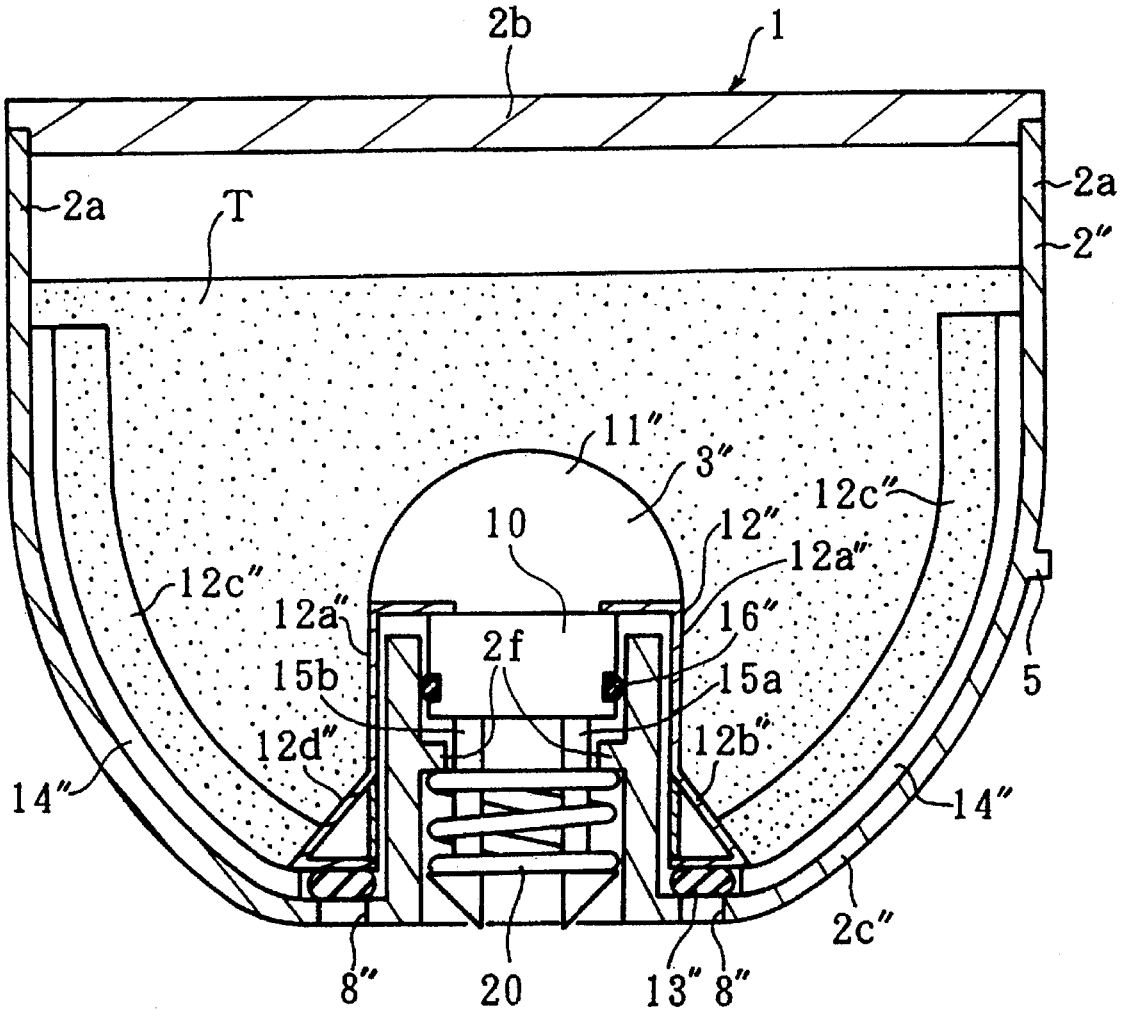
FIG. 22 is a cross-sectional view of the toner cartridge detached from the developing apparatus in the seventh embodiment of the present invention.

FIG. 22 shows the toner cartridge of the seventh embodiment of the present invention. The portions identical with those in the fifth embodiment are denoted by the same symbols, only different aspects are described. The bottom wall 2*c*" of the main body 2" has a shape along a sphere, the blades 12*c*" of the retaining portion 12" of the rotary element 3" and the toner-collecting portions 14" are curved along the bottom wall 2*c*", in place of the cone 11 of the fifth embodiment, a hemisphere 11" constitutes the rotary element 3". Also, the sealing element 16" is present between the column 10 and the support 2*d*. The other aspects are the same as in the fifth embodiment.

First Modification

Figure 23A:
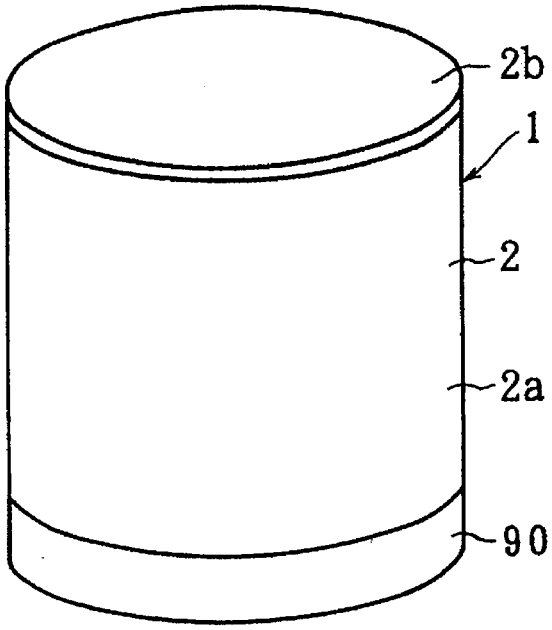
FIG. 23A is an oblique view of the toner cartridges in a modification of the first, second and fifth embodiments.
Figure 23B:
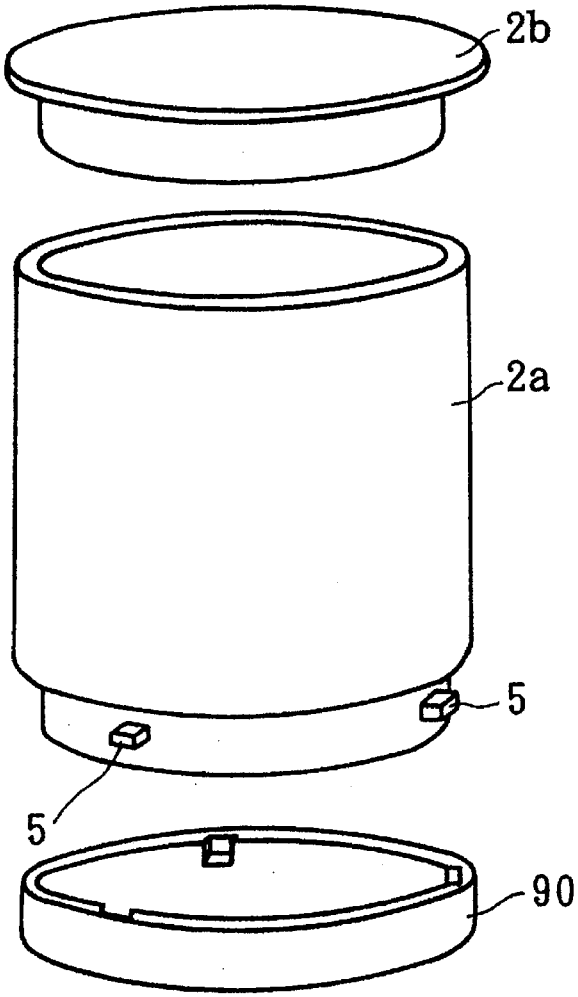
FIG. 23B is an oblique view of the modified toner cartridge with its lid and cover detached.

FIGS. 23A and 23B show a modification of the toner cartridges of the first, second and fifth embodiments. The lower end of the toner cartridge 1 may be removably covered with a cover 90 to prevent accidental movement of the rotary element.

Second Modification

Figure 24A:
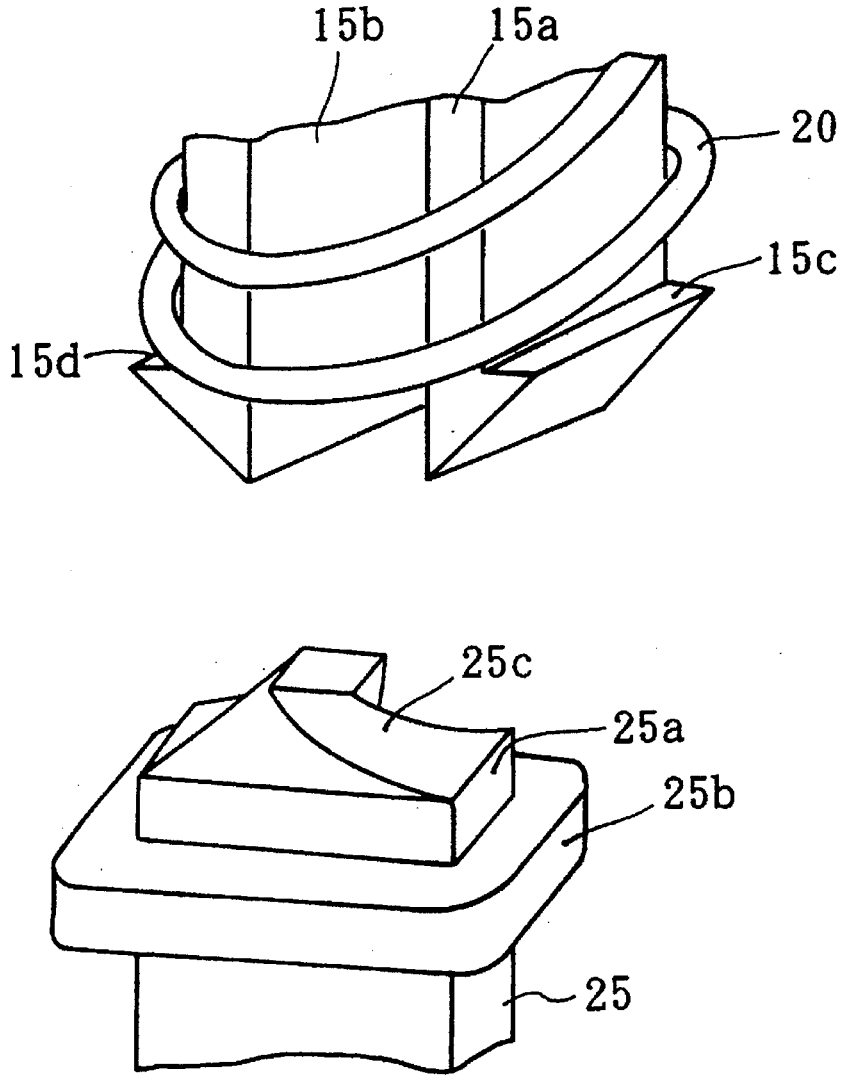
FIG. 24A is a partial oblique view of the toner cartridges in a modification of the first through fifth and seventh embodiments.
Figure 24B:
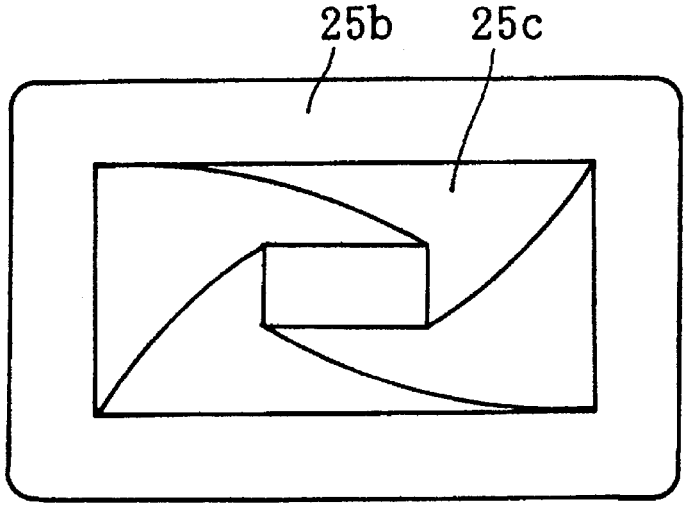
FIG. 24B is a partial plane of the modification.

In contrast to the first through fifth and seventh embodiments, in which the facing direction of the two joints 15*a* and 15*b* and the direction of the longer sides of the rectangular plane view of the rod 25*a* of the rotation driving element 25 are made constant to allow insertion of the rod 25*a* into between the two joints 15*a* and 15*b*, these directions can be arbitrarily chosen in this second embodiment. For example, as shown in FIGS. 24A and 24B, a guide 25*c* is unified to the upper end of the rod 25*a* of the rotation driving element 25. The upper end of the guide 25*c* is of dimensions allowing its insertion into between the two joints 15*a* and 15*b*, and has a rectangular plane view. The lower end of the guide 25*c* has a rectangular plane view agreeing with a plane view of the rod 25*a*, and the distance of the two joints 15*a* and 15*b* is shorter than the longer sides of the rectangular plane view and is longer than the shorter sides of the rectangular plane view. The outer periphery face of the guide 25*c* is spiral, so that the longer side of the rectangular plane view at the upper end communicates with the shorter side of the rectangular plane view at the lower end and the shorter side of the rectangular plane view at the upper end communicates with the longer side of the rectangular plane view at the lower end. The rotation driving element 25 is freely rotatable when it is not driven. Therefore, even if the facing direction of the two joints 15*a* and 15*b* does not agree with the direction of the shorter sides of the rectangular plane view of the rod 25*a* of the rotation driving element 25, the rotation driving element 25 can be rotated by pressing the guide 25*c* from above by the two joints 15*a* and 15*b*, so that the rod 25*a* can be inserted into between the two joints 15*a* and 15*b*.

In the above-described embodiments and modifications, materials for the main body and cover include melamine resin, polyester resin, epoxy resin, polyethylene resin, polypropylene resin, styrol resin, acrylic resin, methacrylic resin, butyral resin, vinyl chloride resin, fluorine resin, polyether, nylon and polyacetal. Materials for the rotary element and toner-collecting portion include melamine resin, polyester resin, epoxy resin, polyethylene resin, polypropylene resin, methacrylic resin, fluorine resin, polyether, nylon and polyacetal. Materials for the ring-shaped elastic sealing element include butyl rubber, polyethylene, ethylene-propylene rubber, chloroprene rubber, nitrile rubber, urethane rubber, acrylic rubber, silicone rubber, fluorine rubber and foamed products thereof. Materials for the opening/closing portion include polyethylene, silicone rubber, fluorine rubber and foamed products thereof, as well as urethane rubber.

The present invention is not limited to the above-described embodiments or modifications. For example, the joint and the rotation driving element may be configured with friction rollers to transmit rotation to each other by friction. Also, the force for pressing the opening/closing portion against the periphery of the outlet and the force for forcing the stopper to go to the rotation-preventing position can be provided by a non-spring material, such as rubber or magnet. Also, in the fifth embodiment described above, in which the outlet for the toner is formed along the inner periphery of the bottom wall of the main body, the outlet may be formed along the outer periphery, and the toner-collecting face of the toner-collecting portion may be inclined against the radial direction to go backwardly along the circumferential direction of the rotation as it goes outwardly along the radial direction of the rotation, so that the toner can be radially outwardly moved and introduced to the outlet by the rotation of the rotary element. Also, the outlet may be formed at the center between the inner and outer peripheries of the bottom wall of the main body, and the toner-collecting face of the toner-collecting portion may be inclined against the radial direction to go backwardly along the circumferential direction of the rotation as it goes outwardly along the radial direction of the rotation at the radially inward rotation side, and may be inclined against the radial direction to go forwardly along the circumferential direction of the rotation as it goes outwardly along the radial direction of the rotation at the radially outward rotation side, so that the toner can be radially moved to the center and introduced to the outlet by the rotation of the rotary element.

What is claimed is:

1. A toner cartridge comprising:

a main body attachable to and detachable from a developing apparatus, the main body having an outlet which is faced downwardly to discharge toner when the main body is attached to the developing apparatus;

a rotary element rotatably attached to the main body, the rotary element having an opening/closing portion for the outlet, a toner-collecting portion housed in the main body, and a joint connectable to a rotation driving element provided on the developing apparatus;

a means for pressing the opening/closing portion against a periphery of the outlet when the main body is detached from the developing apparatus;

a stopper movable between a position for preventing a rotation of the rotary element relative to the main body and a position for allowing the rotation; and a means for forcing the stopper to go to the rotation-preventing position;

wherein rotation of the rotary element causes the opening/closing portion to move between a position above the outlet and a position laterally distanced from the outlet, and causes the toner-collecting portion to collect the toner; and wherein the stopper is movable to the rotation-allowing position when the main body is attached to the developing apparatus.

2. The toner cartridge according to claim 1, wherein the rotary element is vertically movably attached to the main body, and the stopper is unified to the rotary element and is movable to the rotation-allowing position by pressing up the rotary element by the rotation driving element.

3. The toner cartridge according to claim 2, wherein the toner-collecting portion is in contact with an inner face of the main body, and is elastically deformable according to a vertical motion of the rotary element relative to the main body.

4. The toner cartridge according to claim 1, wherein the stopper is vertically movably attached to the main body and rotary element, and is movable to the rotation-allowing position by being pressed up by the rotation driving element, and the opening/closing portion also serves as the toner-collecting portion.

5. A toner cartridge comprising:

a main body attachable to and detachable from a developing apparatus, the main body having an outlet which is faced downwardly to discharge toner when the main body is attached to the developing apparatus; and a rotary element rotatably attached to the main body, the rotary element having a toner-collecting portion housed in the main body, and a joint connectable to a rotation driving element provided on the developing apparatus;

wherein the toner-collecting face of the toner-collecting portion is inclined against a radial direction of rotation of the rotary element so that the toner can be moved to the outlet along the radial direction by the rotation;

wherein the rotary element has an opening/closing portion for the outlet, a means for pressing the opening/closing portion against a periphery of the outlet when the main body is detached from the developing apparatus is provided, and the opening/closing portion can be raised from the periphery of the outlet by pressing up the rotary element by the rotation driving element when the main body is attached to the developing apparatus; and wherein the toner-collecting portion is in contact with an inner face of the main body, and is elastically deformable according to a motion of the rotary element relative to the main body.

6. The toner cartridge according to claim 5, wherein the opening/closing portion has a ring shape concentric with the rotation center of the rotary element.

7. A toner cartridge comprising:

a main body attachable to and detachable from a developing apparatus, the main body having an outlet which is faced downwardly to discharge toner when the main body is attached to the developing apparatus;

a rotary element rotatably attached to the main body, the rotary element having an opening/closing portion for the outlet, a toner-collecting portion housed in the main body, and a joint connectable to a rotation driving element provided on the developing apparatus; and a means for pressing the opening/closing portion against a periphery of the outlet when the main body is detached from the developing apparatus;

wherein the opening/closing portion can be raised from a periphery of the outlet by pressing up the rotary element by the rotation driving element when the main body is attached to the developing apparatus;

wherein the toner-collecting portion is in contact with an inner face of the main body, and is elastically deformable according to a motion of the rotary element relative to the main body; and wherein the toner-collecting portion is crossed with the outlet by a rotation of the rotary element relative to the main body.

* * * * *